US009752321B2

(12) United States Patent
Johnson et al.

(10) Patent No.: US 9,752,321 B2
(45) **Date of Patent: *Sep. 5, 2017**

(54) MULTI-USE BUILDING BLOCK AND METHODS

(71) Applicant: ANCHOR WALL SYSTEMS, INC., Minnetonka, MN (US)

(72) Inventors: Jay J. Johnson, Star Prairie, WI (US); Robert B. Burnquist, Chaska, MN (US); Steven Paul Bennett, Coon Rapids, MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/266,256

(22) Filed: Sep. 15, 2016

(65) Prior Publication Data

US 2017/0002563 A1 Jan. 5, 2017

Related U.S. Application Data

(63) Continuation of application No. 14/891,011, filed as application No. PCT/US2014/037874 on May 13, 2014, now Pat. No. 9,482,002.

(Continued)

(51) Int. Cl.
*E04C 1/00* (2006.01)
*E04B 2/12* (2006.01)

(Continued)

(52) U.S. Cl.
CPC ..... *E04C 1/00* (2013.01); *E04B 1/04* (2013.01); *E04B 2/04* (2013.01); *E04B 2/12* (2013.01);

(Continued)

(58) Field of Classification Search
CPC ..... E04B 1/04; E04B 2002/0265; E04B 2103/02; E04B 2002/0263; E04B 2/10;

(Continued)

(56) References Cited

U.S. PATENT DOCUMENTS 1,585,374 A * 5/1926 Carlsson ..... E04B 2/42 52/569
3,998,022 A * 12/1976 Muse ..... E04B 2/44 52/564

(Continued)

FOREIGN PATENT DOCUMENTS

BE 508 118 A 1/1952
EP 0 130 889 A1 1/1985

(Continued)

OTHER PUBLICATIONS

International Search Report for International Patent Application No. PCT/US2014/037874 mailed Nov. 27, 2014.

(Continued)

*Primary Examiner* — Beth Stephan
(74) *Attorney, Agent, or Firm* — Merchant & Gould P.C.

(57) ABSTRACT

A multi-use block including a block body having at least a first leg. The blocks can be placed in different orientations with respect to each other to form multiple interlocking structures. The block can be a variety of materials, including concrete, and when concrete, used for making walls and columns. Methods of making and methods of use are provided.

7 Claims, 20 Drawing Sheets

Related U.S. Application Data

(60) Provisional application No. 61/823,650, filed on May 15, 2013.

(51) Int. Cl.

| | |
|---|---|
| ***E04C 1/39*** | (2006.01) |
| ***E04B 2/04*** | (2006.01) |
| ***E04C 3/34*** | (2006.01) |
| ***E04B 1/04*** | (2006.01) |
| *E04B 2/02* | (2006.01) |
| *E02D 17/20* | (2006.01) |

(52) U.S. Cl.
CPC ..... *E04C 1/395* (2013.01); *E04C 3/34* (2013.01); *E02D 17/205* (2013.01); *E04B 2002/0202* (2013.01); *E04B 2002/026* (2013.01); *E04B 2002/0265* (2013.01); *E04B 2103/02* (2013.01)

(58) Field of Classification Search
CPC ..... E04B 2/08; E04B 2002/0234; E04B 2002/0208; E04B 2002/0206; E04B 2/18; E04B 2/12; E04B 2/26; E04B 2002/026; E04B 2002/0232; E04C 1/39; E04C 1/00; E04C 1/305; E04C 3/34; E02D 29/02
See application file for complete search history.

(56) References Cited

U.S. PATENT DOCUMENTS

| | | | | |
|---|---|---|---|---|
| D244,201 | S * | 5/1977 | Muse | D25/115 |
| 4,123,881 | A | 11/1978 | Muse | |
| 4,516,364 | A * | 5/1985 | Heider | E04C 1/40 52/590.1 |
| 4,896,999 | A * | 1/1990 | Ruckstuhl | E02D 29/025 405/262 |
| 5,820,305 | A | 10/1998 | Taylor et al. | |
| D460,830 | S * | 7/2002 | Unger | D25/113 |
| 6,464,199 | B1 | 10/2002 | Johnson | |
| 6,679,022 | B1 | 1/2004 | Corporaal | |
| D501,935 | S * | 2/2005 | Dawson | B28B 7/241 D25/118 |
| 7,140,867 | B2 | 11/2006 | Scherer et al. | |
| D610,710 | S * | 2/2010 | LaCroix | D25/113 |
| 7,757,451 | B2 | 7/2010 | Lee Lum | |
| 8,327,833 | B2 | 12/2012 | Scherer et al. | |
| 8,430,603 | B2 | 4/2013 | Price | |
| D700,716 | S * | 3/2014 | Harter | D25/113 |
| 9,089,096 | B1 | 7/2015 | Ulrich | |
| 2001/0054268 | A1 * | 12/2001 | Coleman | E04B 2/12 52/604 |
| 2005/0241257 | A1 | 11/2005 | Price | |
| 2010/0111615 | A1 * | 5/2010 | Bott | E02D 29/025 405/286 |

FOREIGN PATENT DOCUMENTS

| | | | |
|---|---|---|---|
| FR | 493 473 | A | 8/1919 |
| GB | 276 833 | A | 9/1927 |
| GB | 2 179 686 | A | 3/1987 |
| WO | 2008/151403 | A1 | 12/2008 |

OTHER PUBLICATIONS

International Preliminary Report on Patentability and Written Opinion for International Patent Application No. PCT/US2014/037874 mailed Nov. 17, 2015.

* cited by examiner

MULTI-USE BUILDING BLOCK AND METHODS

This application is a continuation of U.S. patent application Ser. No. 14/891,011, filed Nov. 13, 2015, which is a National Stage Application of PCT/US2014/037874, filed May 13, 2014, which claims priority under 35 USC §119(e) to U.S. provisional patent application 61/823650 filed May 15, 2013, and which applications are incorporated herein by reference. A claim of priority is made to each of the above disclosed applications.

TECHNICAL FIELD

This disclosure relates to modular units that can be used in many different ways, including, for example, to build landscaping walls, which may include retaining walls that present one exposed face, or freestanding walls that present two exposed faces. The units disclosed can also be used to build columns and at-grade or above-grade edging strips. The modular units can be used in other applications, such as furniture. This disclosure also relates to methods for making the units and methods for using them.

BACKGROUND

Modular units can be used to build a variety of structures. For example, modular concrete units have been used to build walls for more than a hundred years. In recent years, concrete units have been specifically designed for use in building mortarless landscaping walls (in particular retaining walls that present one exposed face, or freestanding walls that present two, opposed, exposed faces). These units frequently include some form of locator arrangement to assist the installer in achieving the proper orientation of the blocks, and to help to brace the structure against earth pressure, wind pressure, and the like. In the DIY arena in particular, there is a need for simple to use landscape wall—building units. Most of the DIY units that are in use today are sold through retail home center outlets, where shelf space is at a premium and, therefore, managing the number of SKU's (stock keeping units) that are carried in the store is a significant factor.

Modular units can be used in other capacities, such as for furniture including, for example, book shelves, stands, pedestals, etc.

Accordingly, there is a demand for easy-to-use modular units. The modular units can be for a variety of applications. Among the applications include, for example, landscape wall-building blocks that can perform multiple landscape wall and edging functions, and that provide the ornamental features that are important in that arena.

SUMMARY

A multi-use building block is provided. The multi-use block includes an elongate body having a length L1 and a width W1. At least a first leg extends from a first side of the body with its center line perpendicular to the center line of the body. Each leg has a width W2 parallel to the length L1 of the body and a length L2 perpendicular to the length L1 of the body. Like blocks can be placed in different orientations with respect to each other to form multiple interlocking structures.

In another aspect, a method of making a multi-use concrete building block is provided. The method includes providing an elongate, pre-split body having a length 2L1 and a width 2W1. At least a first and second leg extends from a first side of the pre-split body with their center lines perpendicular to the center line of the pre-split body. Each leg has a width W2 parallel to the length 2L1 of the pre-split body and a length L2 perpendicular to the length 2L1 of the pre-split body. At least a first and a second leg extend from a second side of the pre-split body opposite of the first side, with their center lines perpendicular to the center line of the pre-split body. Each leg has a width W2 parallel to the length 2L1 of the pre-split body and a length L2 perpendicular to the length 2L1 of the pre-split body. The upper and lower faces of the pre-split body are planar and parallel to each other. The method includes splitting the pre-split body along the width and along the length to result in four multi-use blocks, with each block having a body with a length L1 and width W1, a first split face, a second split face generally perpendicular to the first split face, and at least one leg extending from a side of the body opposite of the first split face, the leg having a width W2 parallel to the length L1 of the body and a length L2 perpendicular to the length L1 of the body, so that when two of the blocks are placed end-to-end with their legs on the same side, a space is created between the adjacent legs of the two blocks for receiving the leg of a third like block.

In another aspect, a method of using a multi-use building block is provided. The method includes providing a first, second, and third multi-use block. Each of the blocks includes an elongate, body having a length L1 and a width W1, at least a first leg extending from a first side of the body with its center line perpendicular to the center line of the body, each leg having a width W2 parallel to the length L1 of the body and a length L2 perpendicular to the length L1 of the body. The upper and lower faces of the block are planar and parallel to each other. The method includes placing the first block and second block end-to-end with their legs on the same side to form a space between the legs. The method includes orienting the third block to face the first block and second block to place the leg of the third block in the space formed between the adjacent legs of the first block and second block.

In another aspect, a building block is provided comprising: an elongate body having opposite first and second sides, opposite first and second end faces extending between the first and second sides, and opposite first and second bearing faces extending between the first and second sides and the first and second end faces; the first bearing face being an upper face in use; the first bearing face having a contact surface portion that is generally planar; the second bearing face having a contact surface portion that is generally planar; the contact surface portion of the first bearing face and the contact surface portion of the second bearing face being generally parallel to each other.

The first side of the body defines a leg; the first side of the body having a first leg side, an opposite second leg side, and a leg end face extending between the first leg side and second leg side; the first side of the body having a first portion extending between the first end face and the first leg side; the first portion being angled at a first extension angle away from the second side of the body, as the first portion extends from the first leg side to the first end face, the first extension angle being non-zero; the first side of the body having a second portion extending between the second end face and the second leg side; the second portion being angled at a second extension angle away from the second side of the body, as the second portion extends from the second leg side to the second end face, the second extension angle being non-zero.

The leg has a center plane that is generally orthogonal to the first and second bearing surfaces, the center plane bisecting the leg; the first leg side diverging from the second leg side as the first leg side extends away from the first portion of the first side of the body; the first leg side extending away from the first portion at a third extension angle relative to the center plane, the third extension angle being non-zero; the second leg side diverging from the first leg side as the second leg side extends away from the second portion of the first side of the body; the second leg side extending away from the second portion at a fourth extension angle, the fourth extension angle being non-zero.

The leg end face has a first leg end face section and second leg end face section; the first leg end face section being angled inwardly at a fifth extension angle relative to a plane orthogonal to the leg center plane, the first leg end face section extending to about the leg center plane in extension from the first leg side; and the second leg end face section being angled inwardly at a sixth extension angle relative to the plane orthogonal to the leg center plane, the second leg end face section extending to about the leg center plane in extension from the second leg side.

In one aspect, at least the second extension angle, third extension angle, fourth extension angle, and fifth extension angle each are within plus or minus five degrees are each other.

In one aspect, at least the one of the second extension angle, third extension angle, fourth extension angle, and fifth extension angle is within plus or minus 3 degrees of at least one or more of the other of the second extension angle, third extension angle, fourth extension angle, and fifth extension angle.

In one aspect, the second extension angle, third extension angle, fourth extension angle, and fifth extension angle are each within plus or minus 1 degree of each other.

The block can be made of dry cast concrete and the second side of the body can be a split face.

The first end face of the body can be a split face.

The second end face can be angled at a non-zero angle in a direction toward the first end face, as the second end face extends from the second side of the body to the first side of the body.

In one or more embodiments, the first extension angle, second extension angle, third extension angle, fourth extension angle, fifth extension angle and sixth extension angle are each less than 10 degrees.

The first extension angle and sixth extension angle each can be within +/−5 degrees of each of the second extension angle, third extension angle, fourth extension angle, and fifth extension angle.

Any one or all of the first extension angle, second extension angle, third extension angle, fourth extension angle, fifth extension angle and sixth extension angle can be within +/−1 degree of each other.

In some embodiments, at least the second extension angle, third extension angle, fourth extension angle, and fifth extension angle can be within +/−1 degree of each other.

In another aspect, a free standing wall is provided comprising: a plurality of blocks that can be constructed as variously characterized above arranged in multiple courses; each course comprising the blocks being in two rows, with the blocks in each row laid end to end with the second side of each block forming a portion of an exposed face of the wall, and the leg of each block in a first of the rows being between adjacent legs of two blocks in a second of the rows.

In another aspect, a column is provided comprising: a plurality of the blocks as variously characterized above arranged in multiple courses; each course comprising four of the blocks arranged in a rectangle with the second side of each block and an end of an adjacent block forming a side of the column.

The leg end face of each block can be angled to match an angle of one of the first or second leg sides of an adjacent block, whereby the blocks are locked together to resist lateral movement of each of the blocks in the course.

In one or more embodiments, the blocks in a course of blocks are rotated 90 degrees around the vertical axis of the column from the blocks in an adjacent course.

The second side of one of the blocks, and the first end face of an adjacent block, each may have a split face and form a side of the column.

In another aspect, a building block is provided comprising: a body having opposite first and second sides, opposite first and second end faces extending between the first and second sides, and opposite first and second bearing faces extending between the first and second sides and the first and second end faces; the first bearing face being an upper face in use; the first bearing face having a contact surface portion that is generally planar; the second bearing face having a contact surface portion that is generally planar; the contact surface portion of the first bearing face and the contact surface portion of the second bearing face being generally parallel to each other; the first side of the body defining a leg; the first side of the body having a first leg side, an opposite second leg side, and a leg end face extending between the first leg side and second leg side; the first side of the body having a first portion extending between the first end face and the first leg side; the first side of the body having a second portion extending between the second end face and the second leg side; the leg being narrower proximal the first portion and second portion of the first side of the body than at the leg end face; and the leg end face defining a recess in complete extension between the first and second bearing faces and extending inwardly toward the second side of the body; the recess extending at least partially between the first leg side and second leg side.

The leg end face recess may extend inwardly at least 90% of an extension between the first leg side and second leg side.

The leg end face recess may extend inwardly at least 95% of an extension between the first leg side and second leg side.

The leg end face recess may extend inwardly at least 98% of an extension between the first leg side and second leg side.

The leg end face recess can be defined by at least a first leg end face section and second leg end face section; at least the first leg end face section can extend inwardly in at least partial extension from the first leg side; or the second leg end face section can extend inwardly in at least partial extension from the second leg side.

At least one of the first leg end face section and second leg end face section can be generally non-curved sections.

At least one of the first leg end face section and second leg end face section can be generally straight sections.

The first leg end face section and second leg end face section may meet at an intersection in the first leg end face.

In one or more embodiments, the intersection of the first leg end face section and second leg end face section is along a region of the leg end face between 45-55% of the leg end face between the first leg side and second leg side.

In one or more embodiments, the intersection of the first leg end face section and second leg end face section is along a region of the leg end face between 48-52% of the leg end face between the first leg side and second leg side.

In one or more embodiments, the first leg end face section extends inwardly in complete extension from the first leg side to the second leg end face section; and the second leg end face section extends inwardly in complete extension from the second leg side to the first leg end face section.

The first leg end face section can be angled toward the second leg end face section from the first leg side at a first extension angle, the first extension angle being non-zero; and the second leg end face section can be angled toward the first leg end face section from the second leg side at an angle about equal to the first extension angle.

The first portion of the first side of the body can be angled at the first extension angle toward the second side as it extends from the first end face to the first leg side.

The second portion of the first side of the body can be angled at the first extension angle toward the second side as it extends from the second end face to the second leg side.

The first portion of the first side of the body can be angled at a non-zero angle toward the second side as it extends from the first end face to the first leg side.

The second portion of the first side of the body can be angled at a non-zero angle toward the second side as it extends from the second end face to the second leg side.

The angle of the first portion and angle of the second portion are about equal, in one or more embodiments.

The leg end face recess can be defined by a first leg end face section and second leg end face section; the first leg end face section can be angled toward the second leg end face section from the first leg side at an angle, the angle being non-zero; and the second leg end face section can be angled toward the first leg end face section from the second leg side at an angle, the angle being non-zero.

In one or more embodiments, the angle of the first leg end face and second leg end face are about equal to the angles of the first portion and second portion.

A distance between the first and second end faces at the second side of the body can be greater than a distance between the first and second end faces at the first side of the body.

The second end face can be angled in a direction toward the first end face, as the second end face extends from the second side of the body to the first side of the body, the angle being non-zero.

The second side of the body can be a split face.

The first end face can be a split face.

In another aspect, a free standing wall is provided comprising: a plurality of blocks as variously characterized above and arranged in multiple courses; each course comprising the blocks being in two rows, with the blocks in each row laid end to end with the second side of each block forming a portion of an exposed face of the wall, and the leg of each block in a first of the rows being between adjacent legs of two blocks in a second of the rows.

In another aspect, a column is provided comprising a plurality of the blocks as variously characterized above and arranged in multiple courses; each course comprising four of the blocks arranged in a rectangle with the second side of each block and an end of an adjacent block forming a side of the column.

The leg end face of each block can be angled to match an angle of one of the first or second leg sides of an adjacent block, whereby the blocks are locked together to resist lateral movement of each of the blocks in the course.

In one or more embodiments, the blocks in a course of blocks are rotated 90 degrees around the vertical axis of the column from the blocks in an adjacent course.

The second side of one of the blocks, and the first end face of an adjacent block each may have a split face and form a side of the column.

In another aspect, a building block is provided comprising a body having opposite first and second sides, opposite first and second end faces extending between the first and second sides, and opposite upper and lower faces extending between the first and second sides and the first and second end faces; the upper and lower faces being generally planar and generally parallel to each other; a leg extending from the first side of the body; the leg having opposite leg sides and an end leg face; the leg sides extending between the first side of the body and the end leg face; the first side of the body having a first portion extending between the first end face and one of the leg sides; the first side of the body having a second portion extending between the second end face and the other of the leg sides; a widest portion of the leg being at the end leg face; and the end leg face including a recessed portion.

The end leg face can have a first section recessed inwardly from one of the leg sides at an angle; and the end leg face can have a second section recessed inwardly from the other of the leg sides at an angle which is the same as the angle of the first section.

The first portion of the first side can angle inwardly as it extends from the first end face to one of the leg sides; and the second portion of the first side can angle inwardly as it extends from the second end face to the other of the leg sides.

The angle of the first portion to the one of the leg sides, and the angle of the second portion to the other of the leg sides can be the same angle as the angle of the first section end leg face and second section end leg face.

The block can be made of dry cast concrete and the second side of the body can be a split face.

The first end face can be a split face.

The body can be longer at the second side than the first side.

The second end face can extend inwardly as it extends from the second side of the body to the first side of the body.

In another aspect, a building block is provided comprising: a body having opposite first and second sides, opposite first and second end faces extending between the first and second sides, and opposite first and second bearing faces extending between the first and second sides and the first and second end faces; the first bearing face being an upper face in use; the second end face being oriented at an acute angle relative to the second side; and the first side of the body defining a leg with a free end extending generally transverse to a remaining portion of the body; the leg being spaced from the first and second end faces of the body; and the leg being narrower at its proximal end than at its distal end, the proximal end being closer to the second side of the body than the distal end, and the distal end defining the free end of the leg.

The block can be made of dry cast concrete and the second side of the body can comprise a split face.

The first end face of the body can comprise a split face.

The first end face of the body can be generally perpendicular to the second side of the body.

The block can be configured and arranged such that when a first and second block, each as variously characterized above, are set next to each other: a portion of the first body end face of the first block is in contact with a portion of the second body end face of the second block; the second sides of the first block and second block extend generally along a common line and point in the same direction; and a gap results between the legs of the first block and second block forming an opening shaped to accept the leg of a third like-formed block when a third block is oriented with its second side pointed in an opposite direction of the second sides of the first block and second block.

The second side can have a first portion extending from the first end face to the leg, and a second portion extending from the second end face to the leg.

The building block can be configured and arranged such that when a first, second, third, and fourth block, each as variously characterized above, are set next to each other: the first body end face of the second block is generally aligned with, and pointing in generally a same direction as, the second side of the first block; the third block is next to, and in contact with, the second block, with the first body end face of the third block generally aligned with, and pointing in generally a same direction as, the second side of the second block; the fourth block is between, and in contact with, the third block and first block with the first body end face of the fourth block generally aligned with, and pointing in generally a same direction as, the second side of the third block; the first body end face of the first block is generally aligned with, and pointing in generally a same direction as, the second side of the fourth block; and gaps are formed between: (i) respective second portions of the first side of each of the first, second, third, and fourth blocks, and (ii) respective distal ends of the leg of each of the first, second, third, and fourth blocks; each of the gaps being filled by a leg of one of the first, second, third, and fourth blocks.

In another aspect, a building block is provided comprising: a body having opposite first and second sides, opposite first and second end faces extending between the first and second sides, and opposite first and second bearing faces extending between the first and second sides and the first and second end faces; the first bearing face being an upper face in use; the first bearing face having a contact surface portion that is generally planar; the second bearing face having a contact surface portion that is generally planar; the contact surface portion of the first bearing face and the contact surface portion of the second bearing face being generally parallel to each other; the second side having opposite ends; a second side center plane generally orthogonal to the first and second bearing surfaces being in the middle of the opposite ends of the second side; the first side of the body defining a leg; the leg having a leg center plane that is generally orthogonal to the first and second bearing surfaces, the leg center plane bisecting the leg; an outer perimeter of the leg being symmetrical about the leg center plane; the leg center plane being non-coplanar with the second side center plane; and wherein the first bearing face has an outer perimeter shape, and the outer perimeter shape of a non-leg portion of the first bearing face is a non-mirror image relative to the second side center plane.

In any of the above combinations, the block can be concrete.

In any of the above combinations, the block can be dry cast concrete.

In another aspect, a multi-use concrete block is provided including an elongate body having a length L1 and a width W1, at least a first leg extending from a first side of the body with its centerline perpendicular to the centerline of the body, each leg having a width W2 parallel to the length L1 of the body and a length L2 perpendicular to the length L1 of the body, wherein when two of the blocks are placed end to end with their legs on the same side a space is created between the adjacent legs of the two blocks for receiving the leg of a third like block, the upper and lower faces of the block being planar and parallel to each other. A second leg can extend from the first side of the block, the second leg having the same dimensions as the first leg and also having its centerline perpendicular to the centerline of the body; the second leg being spaced from the first leg to create a space between the legs for receiving one of the legs of a third like block.

A variety of examples of desirable features or methods are set forth in the description that follows.

DETAILED DESCRIPTION

A. The First Embodiment, FIGS. 1-13

Figure 1:
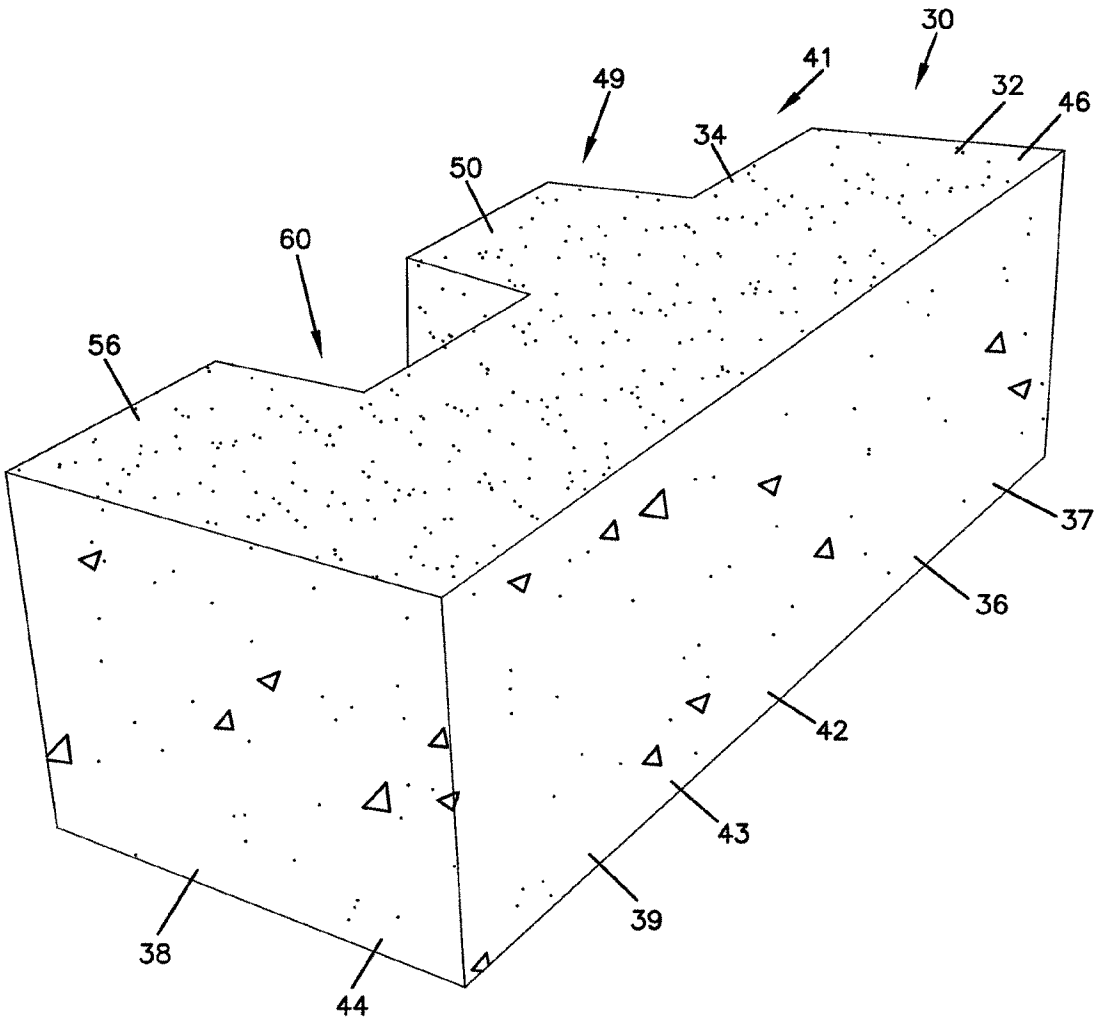
FIG. 1 is a perspective view of a first embodiment of a multi-use block, constructed in accordance with the principles of this disclosure.
Figure 2:
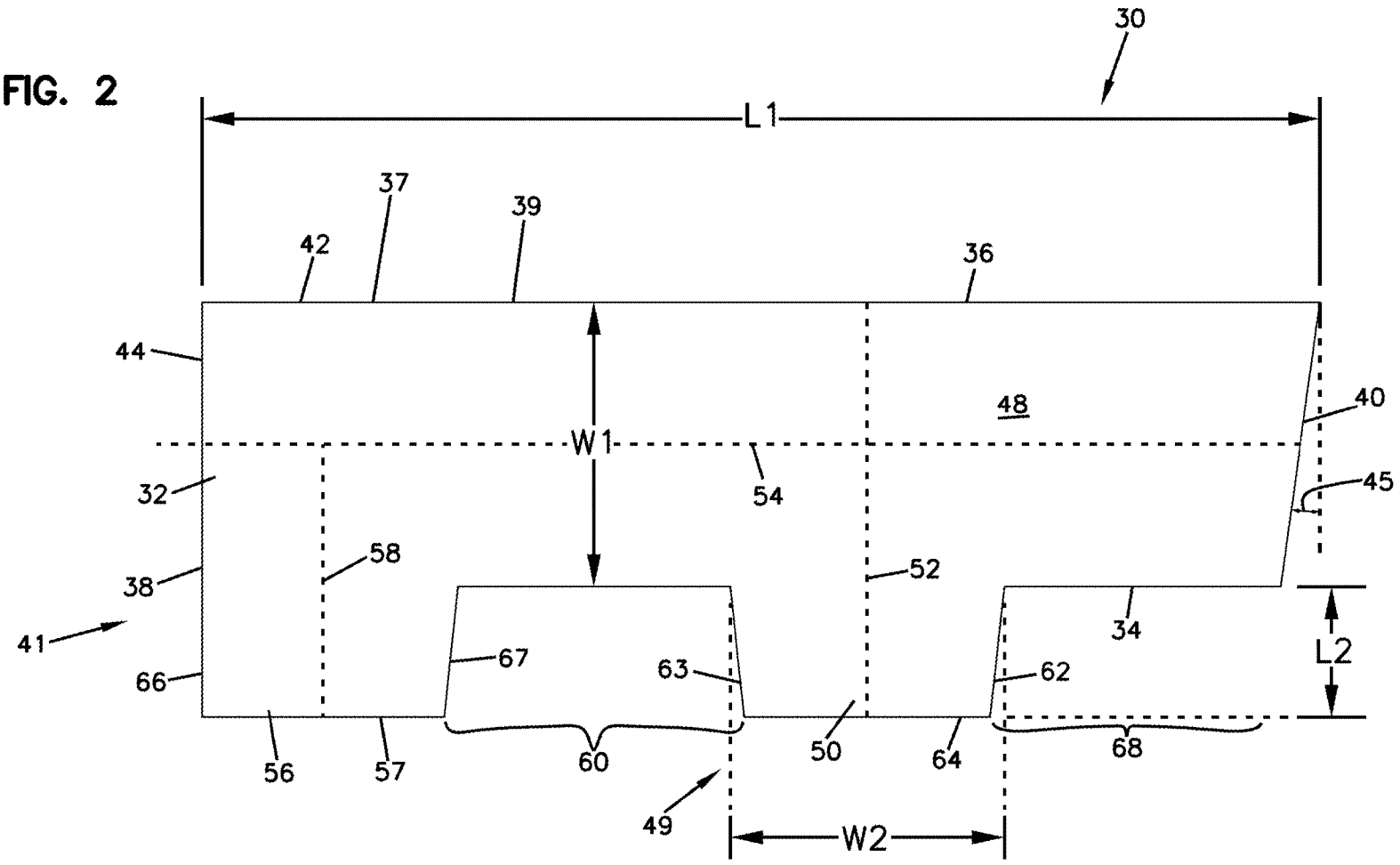
FIG. 2 is a top view of the block of FIG. 1.
Figure 3:
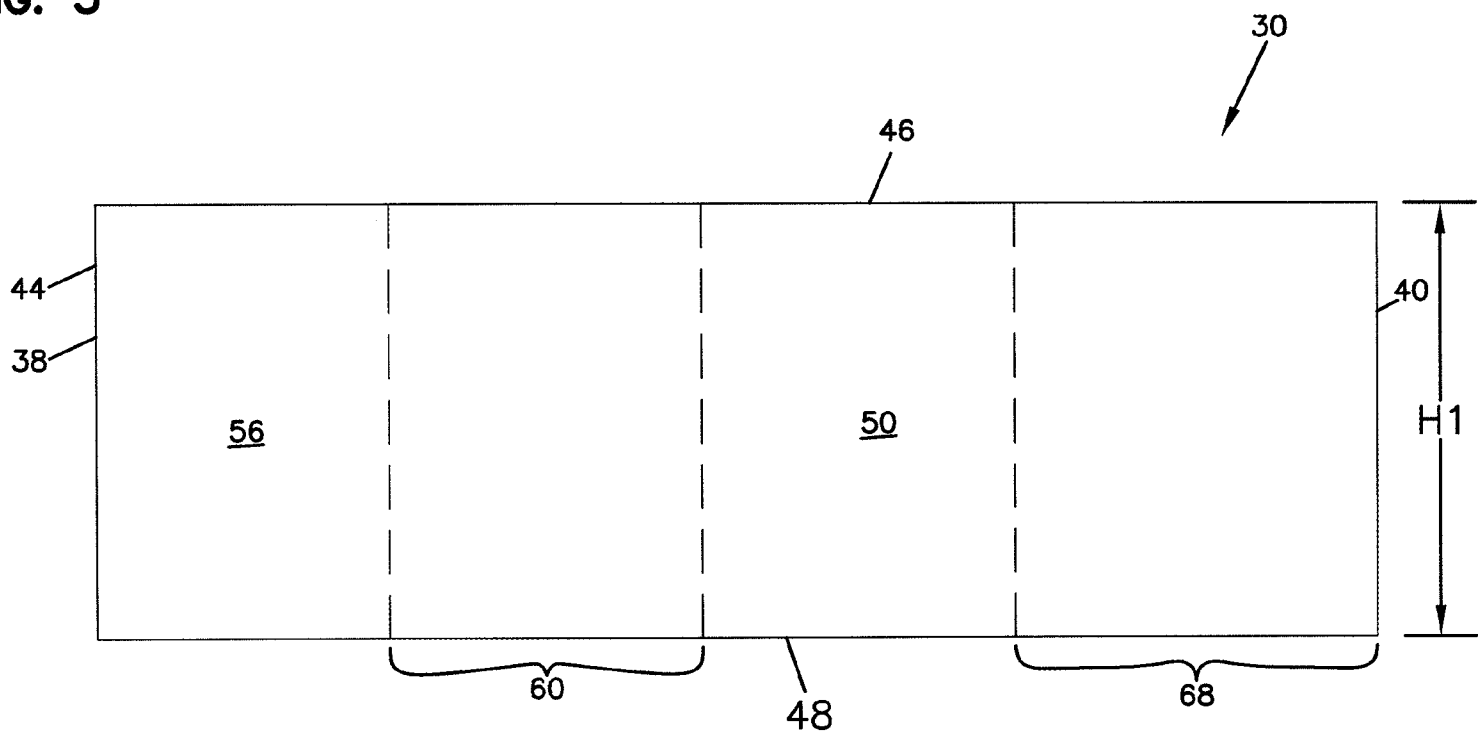
FIG. 3 is a rear view of the block of FIG. 1.

(1) The Block, FIGS. 1-3

FIG. 1 is a perspective view of a first embodiment of a multi-use block 30, constructed in accordance with the principles of this disclosure. The block 30 is shaped in a way to allow it many varied uses. The block 30 can be made out of a many different materials. When made of concrete, the block 30 can be used in freestanding walls and columns. The walls and columns can be made in many different ways, some of which are described further below, to result in various aesthetically pleasing walls. The block 30 is made in a way to efficiently utilize materials and manufacturing techniques.

When used as a building block for walls and columns, for example, typically, the block 30 will be molded from dry cast concrete. However, it can be made of wet cast concrete, plastic or other moldable material. The block 30 can be molded, as shown in FIG. 1, or it can be molded and then subject to manufacturing techniques to result in the block 30 shown in FIG. 1. Some preferred manufacturing methods will be described further below.

In other arrangements, the block 30, when utilized in, for example, casual furniture arrangements can be made from non-concrete materials. The non-concrete materials can include, for example, wood or plastic. Example plastics can include thermoset plastics, polystyrene, PVC; or other moldable material.

The block 30 includes a block body 32. The block body 32 has a length L1 (FIG. 2) and width W1 (FIG. 2). In general, the body 32 will be elongate, in that the length L1 will be greater than the width W1. The body 32 can be "generally rectangular." As used herein, the term "generally rectangular" can include shapes having 2 pairs of opposite sides that can deviate from being parallel, with the deviations being typically less than about +/−15 degrees.

The block body 32 has a first side 34 and an opposite second side 36. Between the first side 34 and second side 36 are opposite first and second end faces 38, 40. As will be explained further below, in some implementations and when the block body 32 is made from concrete, the second side 36 will also be a first split face 42, and the first end face 38 will also be a second split face 44. By the term "split face", it is meant that the faces of the block are created as a result of a splitting process.

In some uses of the block 30, the second side 36 will be a front section 37 having a front face 39. In some structures, the front face 39 will be exposed when the block 30 is assembled with like blocks 30 in a structure. The first and second end faces 38, 40 extend rearwardly from the front face 39. The block 30 will have a rear section 41 formed integrally with the front section 37.

The block 30 has an upper face 46 and an opposite lower face 48 (FIG. 2). In general, the upper face 46 and lower face 48 are planar and parallel to each other. The upper face 46 and lower face 48 include no protrusions or projections or indentations. In this example, the block 30 is free of through-holes or cores.

In FIG. 2, it can be seen how the second end face 40, which extends between the second side 36 and the first side 34, tapers inwardly as the end face 40 extends from the second side 36 to the first side 34. As used herein, the term "taper(s)" means generally to angle, so to "taper inwardly" means to be angled inwardly. In embodiments where the second side 36 is also the first split face 42, when the block 30 is made from concrete, the second end face 40 tapers inwardly as the second end face 40 extends from the first split face 42 to the first side 34. The angle of taper 41 is typically less than 10 degrees.

The block 30 includes at least a first leg portion 49, which can be part of the rear section 41. The first leg portion 49 can include a first leg 50. The first leg 50 extends from the first side 34 of the body 32. The leg 50 will have a center line 52 that is generally perpendicular to the center line 54 of the body 32. The leg 50 is generally rectangular.

In FIG. 2, it can be seen that the first leg 50 has a width W2, which is parallel to the length L1 of the body 32. The first leg 50 has a length L2 that is generally perpendicular to the length L1 of the body 32.

The block 30 is shaped such that when two of the blocks 30 are placed end-to-end with their respective at least first leg 50 being pointed in the same direction (that is, on the same side), a space is created between the adjacent legs of the two blocks for receiving the generally rectangular leg 50 of a third like block. This is described further below.

Still in reference to FIG. 2, the block 30 further includes a second generally rectangular leg 56. The second leg 56 has the same dimensions as the first leg 50. The second leg 56 also includes a center line 58 that is perpendicular to the center line 54 of the body 32.

The second leg 56 is spaced from the first leg 50 to create a receiving space 60 between the legs 50, 56 for receiving one of the generally rectangular legs 50 or 56 of a third like block 30.

In the embodiment of FIG. 2, the first leg 50 has a pair of opposite leg sides 62, 63. In preferred embodiments, the leg sides 62, 63 are tapered toward each other as they extend away from the body 32, terminating at end leg face 64. The end leg face 64 is generally planar. The angle of the leg sides 62, 63, as measured relative to the direction of the length L2 can be less than 10 degrees, for example, 4-8 degrees.

The second leg 56 has opposite leg sides 66, 67. Many embodiments are possible, and in this example, the leg side 67 tapers in a direction toward the other leg side 66, while the leg side 66 is generally straight as it extends form the body 32. The leg side 67 can taper at an angle of less than 10 degrees, for example 4-8 degrees.

Still in reference to FIGS. 1 and 2, the block 30 includes one of the legs 56 being at one end of the body 32. The first leg 50 is spaced from the second end face 40. The space between the first leg 50 and second end face 40 forms a receiving space 68 for receiving one of the legs 50, 56 of a like block 30.

Many different embodiments of the block 30 can be made. One example block 30 has a length L1 of 11-12 inches, for example about 11.8 inches. It has a width W1 of about 2.5-3.5 inches, for example about 3 inches. The leg width W2 is about 2-3 inches, for example about 2.6 inches. The receiving spaces 60, 68 will be 2-3 inches, for example about 2.8-2.9 inches. The height H1 (FIG. 3) will be about 3.5-4.5 inches, for example 4 inches.

Figure 13:
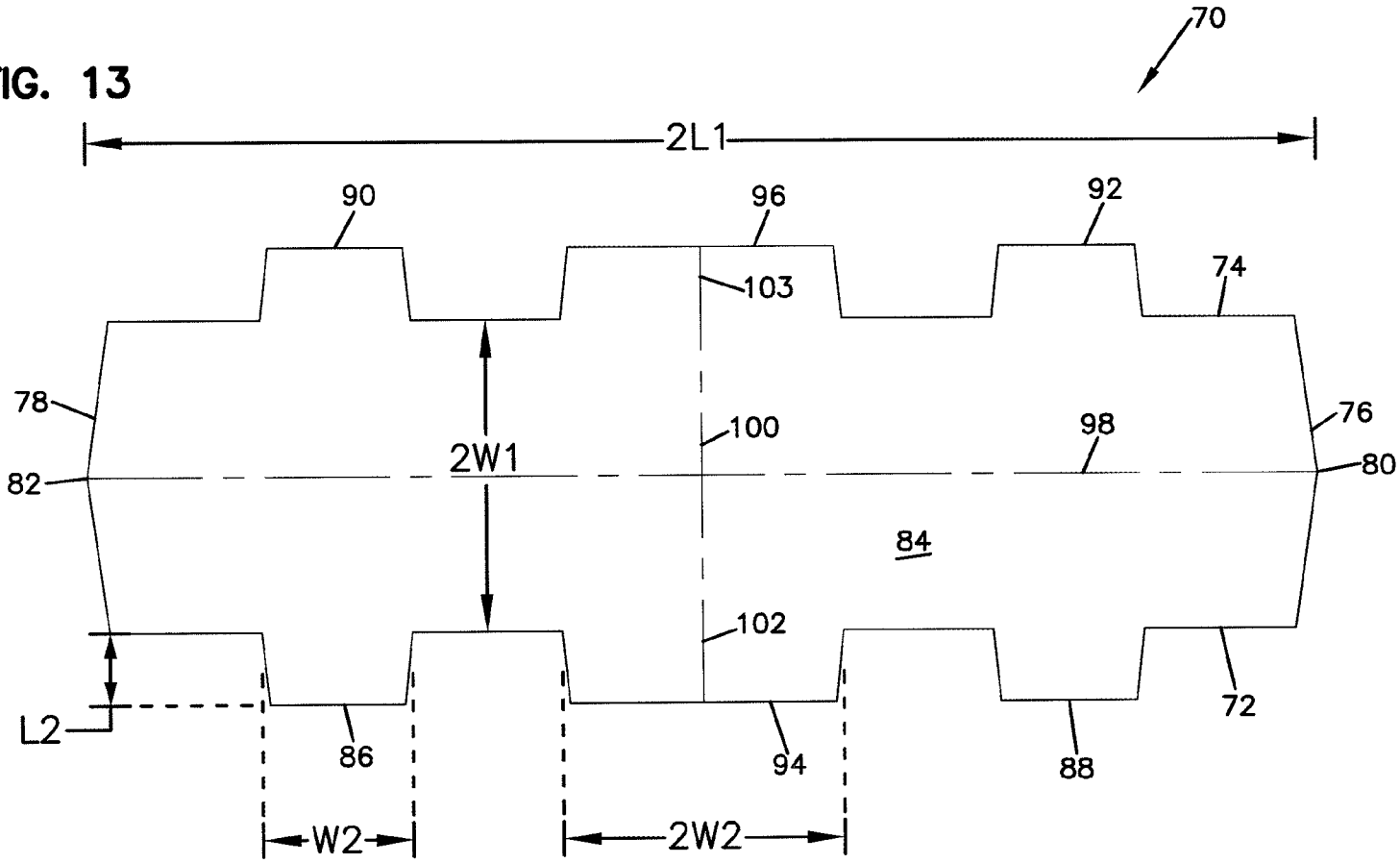
FIG. 13 is a top view of one embodiment of a pre-split concrete body used in making the block of FIG. 1.

(2) Method of Making the Block of FIGS. 1 and 2, FIG. 13

Before turning to various freestanding walls, columns, and other structures that can be made from the block 30, attention is directed to FIG. 13, which illustrates one example method of making the block 30.

In FIG. 13, a pre-split body 70 is illustrated. The pre-split body 70 can be made by molding dry cast concrete. The pre-split body 70 has a length 2L1 and a width 2W1 and can be generally rectangular.

The pre-split body 70 includes a first side 72 and an opposite second side 74. Extending between the first side 72 and second side 74 are opposite first and second end walls 76, 78.

In the example shown in FIG. 13, the first end wall 76 tapers from a center 80 inwardly as the end wall 76 extends from the center 80 to each of the first side 72 and second side 74. Similarly, the second end wall 78 tapers inwardly as it extends from a center 82 to the first side 72 and second side 74.

The pre-split body 70 will have a generally planar upper face 84 and lower face. The upper face 84 and lower face will be generally parallel to each other. The pre-split body 70 can be free of through-holes or cores.

Still in reference to FIG. 13, at least a first leg 86 and second leg 88 extend from the first side 72 of the pre-split body 70. Each of the legs 86, 88 has a width W2 parallel to the length 2L1 of the pre-split body 70, and a length L2 perpendicular to the length 2L1 of the pre-split body 70. The legs 86, 88 are generally rectangular.

The pre-split body 70 further includes at least a first leg 90 and a second leg 92 extending from the second side 74 of the pre-split body 70. The first leg 90 and second leg 92 will generally be the same size as the first leg 86 and second leg 88, and have their center lines perpendicular to the center line of the pre-split body 70. The legs 90, 92 can be generally rectangular.

The pre-split body 70 also includes a third leg 94 extending from the first side 72 and a third leg 96 extending from the second side 74. In FIG. 13, the third leg 94 is between and spaced from the first leg 86 and second leg 88. The third leg 96 is between and spaced from the first leg 90 and second leg 92. The third legs 94, 96 have center lines perpendicular to the center line of the pre-split body 70. The third legs 94, 96 have a width of twice the width of the first and second legs 86, 88, 90, 92, which is a width of 2W2. The third legs 94, 96 are generally rectangular.

To make the block of FIG. 1, the method includes splitting the concrete pre-split body 70 along the length at splitting line 98 and along the width at splitting line 100 to result in four multi-use blocks 30. The resulting four multi-use blocks 30 will each have a body 32 with length L1 and width W1, first split face 42, created along the splitting line 98 and second split face 44 created along the splitting line 100. The second split face 44 will be generally perpendicular to the first split face 42.

The step of splitting can include, first, splitting the pre-split body along the splitting line 100, which is along the width 2W1, to result in a first and second split block, with each split block having a length of L1. After that step, then the first split block and second split block can be split along the splitting line 98, which is along the length L1, to result in the four multi-use blocks 30.

The step of splitting along the width of the pre-split body 70 can also include splitting the pre-split body 70 along a center line 102, 103 of the third legs 94, 96. In FIG. 13, the center line 102, 103 is the same line as the splitting line 100.

When the pre-split body 70 is made in the way described above, the result will be four multi-use blocks 30, having first split face 42, second split face 44 generally perpendicular to the first split face 42, and at least one generally rectangular leg 50, 56 extending from the side 34 opposite the first split face 42.

A variety of techniques for splitting the concrete pre-split body 70 can be used. In one example, the splitting can be done in accordance with U.S. Pat. No. 8,327,833 incorporated herein by reference. Alternatively, a basic splitting process can be used. For example, in one method, the step of splitting along the splitting line 100 across the width 2W1 uses a basic splitting technique, while the step of splitting along the split line 98 across the length is done in accordance with U.S. Pat. No. 8,327,833.

Other methods of making the block 30 can include making the block 30 with mold-textured faces as described in U.S. Pat. No. 6,464,199, which is incorporated herein by reference. The block 30 can also have a sculpted face at 36, 38 as described in U.S. Pat. No. 7,140,867, which is incorporated herein by reference.

(3) Example Structures, FIGS. 4-12

The block 30, when made of concrete, can be used to make a variety of walls, including freestanding walls, small retaining walls (garden walls), columns, edging walls, single course edging, and other structures. These structures can be made to have aesthetically pleasing exterior appearances.

Figure 4:
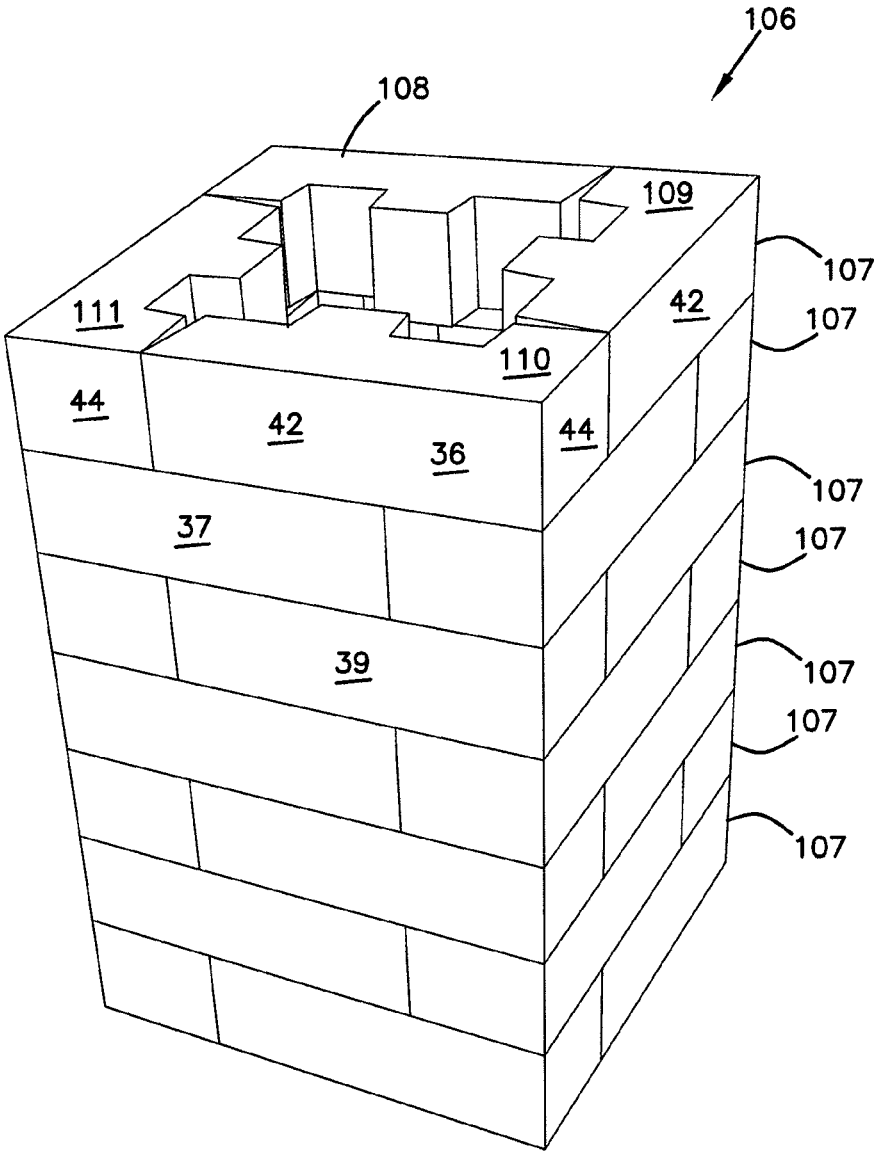
FIG. 4 is a perspective view of one embodiment of a column that can be constructed with the block of FIG. 1.
Figure 5:
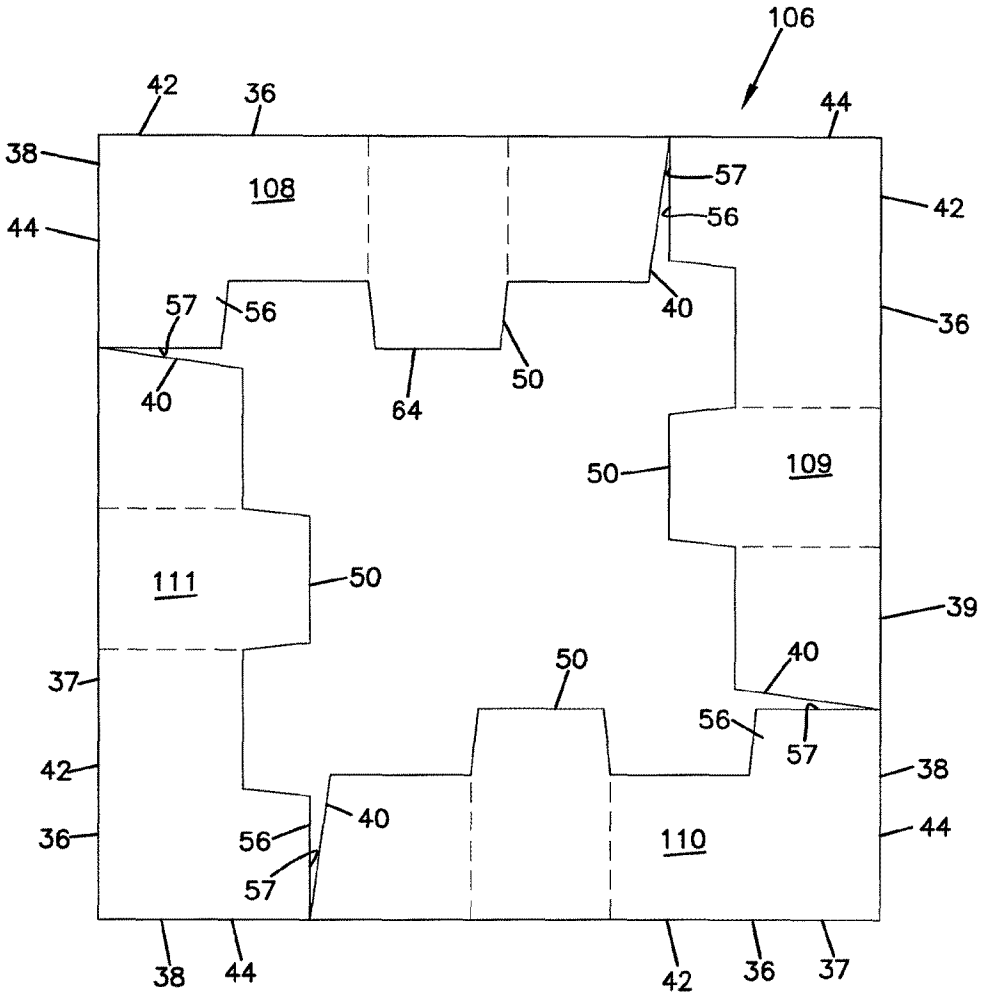
FIG. 5 is a top view of the column of FIG. 4.

FIG. 4 illustrates one example column 106 that can be constructed from the block 30. FIG. 5 illustrates the top view of the column of FIG. 4. The column 106 includes a plurality of courses 107 of the blocks 30. In the example shown, there are four blocks 30 in each course. In the top course, the four blocks 30 are shown at 108, 109, 110, and 111.

It should be appreciated that the column 106 is formed so that the exterior surfaces are all either the first split face 42 or second split face 44, to give the column 106 an attractive exterior appearance. As can be seen in the drawings, the column 106 is formed by starting with one of the blocks, for example first block 108, and then laying second block 109 adjacent to it, such that the end leg face 57 of the second leg 56 abuts the second end face 40 of the first block 108. Also, the second split face 44 of the second block 109 will be aligned with the first split face 42 of the first block 108. Next, the third block 110 is laid adjacent to the second block 109, such that the second split face 44 of the third block 110 is aligned with the first split face 42 of the second block 109 and the end leg face 57 of the third block 110 abuts the second end face 40 of the second block 109. Finally, the fourth block 111 is placed in between the first block 108 and third block 110 and opposing the second block 109. The first split face 42 of the fourth block 111 will be laid so that it is next to and aligned with the second split face 44 of the first block 108. The second split face 44 of the fourth block 111 will be aligned with the first split face 42 of the third block 110. In adjacent courses 107 of the column 106 the blocks have opposite top face 46 or bottom face 48 facing upward so that the blocks in the column are not vertically aligned in adjacent courses.

Figure 6:
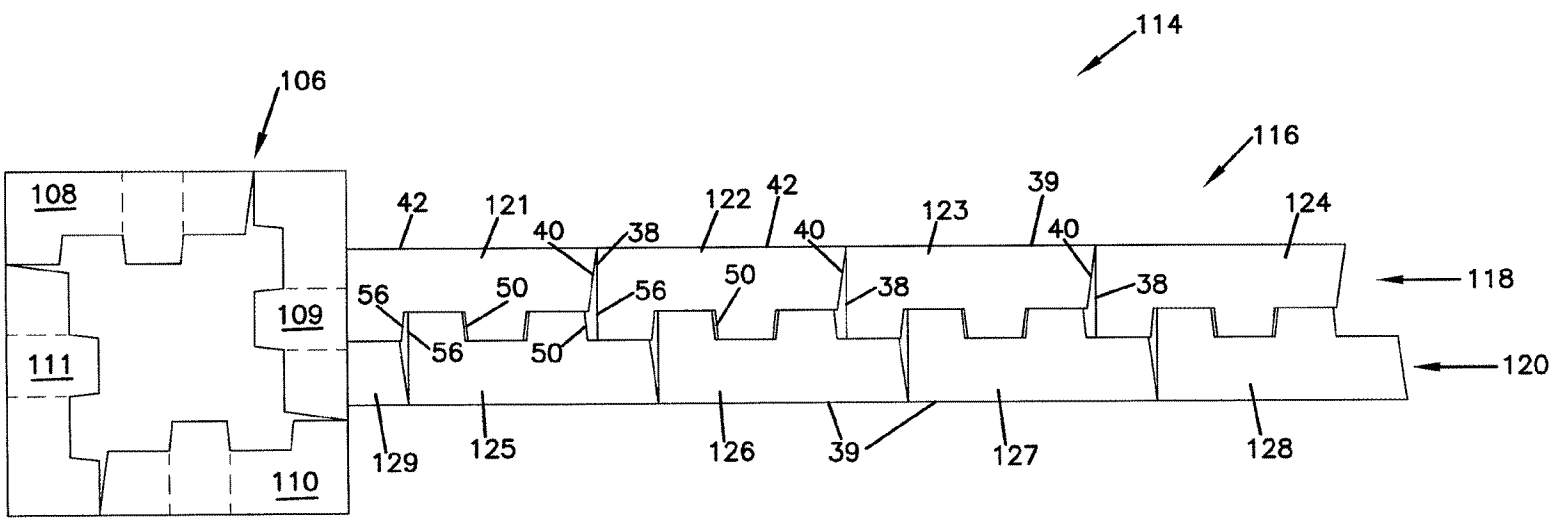
FIG. 6 is a top view of one embodiment of a column and wall that can be constructed with the block of FIG. 1.

FIG. 6 illustrates the top view of a combination column and freestanding wall at 114. The wall 114 abuts the column 106. The wall 114 is made from the blocks 30 in a nested formation 116. By "nested" it is meant that when two of the blocks 30 are placed end-to-end with their legs pointing in the same direction, a space is created between the adjacent legs of the two blocks and receives the leg of a third like block.

In FIG. 6, a first row of blocks is shown at 118, while a second row of blocks is shown at 120 opposing and nested with the first row 118. The first row 118 includes blocks 121, 122, 123, 124 arranged end-to-end, such that the second end face 40 of the block 121 is adjacent to the first end face 38 of the block 122, and the legs 50, 56 are pointing in the same direction, toward the second row 120. Similarly, the second end face 40 of the block 122 is adjacent to the first end face 38 of the block 123, and the second end face 40 of the block 123 is adjacent to the first end face 38 of the block 124.

When the blocks 121-124 are arranged as shown in the first row 118, the receiving spaces 60, 68 (FIG. 2) are created, to receive the legs 50, 56 from the blocks 125, 126, 127, 128 making up the second row 120. The blocks 125-128 are arranged end-to-end, as described for the first row 118. As can be seen in FIG. 6, the second leg 56 of the block 125 is received in the space 60 (FIG. 2) between the first leg 50 and second leg 56 of the block 121. The first leg 50 is received in the space 68 (FIG. 2) of the block 121. This pattern continues throughout the wall 114.

It should be noted that row 120 also includes a partial block section 129. A splitting groove may be made across the upper or lower face 46, 48 of the block 30 to facilitate the splitting to form the block section 129, when one is needed.

Figure 7:
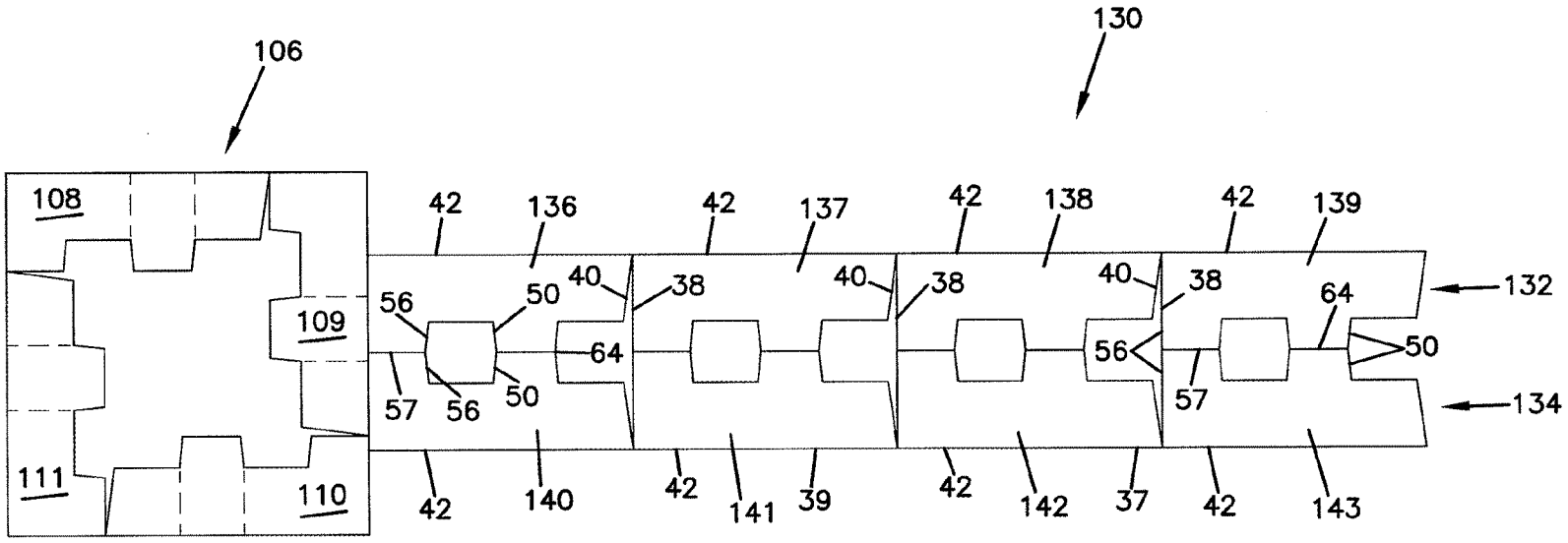
FIG. 7 is a top view of another embodiment of a column and wall that can be constructed with the block of FIG. 1.

FIG. 7 illustrates a top view of another embodiment of a combination column 106 and wall 130, constructed from blocks 30 of FIG. 1. In this embodiment, the wall 130 is a non-nested wall, in which the end leg faces 57, 64 abut each other.

In FIG. 7, the wall includes a first row 132 opposed to a second row 134. The first row includes blocks 136, 137, 138, 139 made according to the block 30 of FIG. 1. The second row 134 includes blocks 140, 141, 142, 143, also made according to the block 30 of FIG. 1. The blocks 136-139 of the first row 132 are arranged end to end, so that the first split face 42 of each block is aligned with the next adjacent block. The second end face 40 of the block 136 abuts against the first end face 38 of the block 137. Similarly, the second end face 40 of the block abuts the first end face 38 of the block 138. Similarly, the second end face 40 of the block 138 abuts the first end face 38 of the block 139.

The second row 134 is arranged similarly as the first row 132, with respective end faces 40, 38 abutting each other, while the first split face 42 of each of the blocks 140-143 is aligned with the next adjacent block.

When arranged in this manner, the first leg 50 of each of the blocks 136-139 is opposed to and abuts one of the first legs 50 of the blocks 140-143. Similarly, the second leg 56 of each of the blocks 136-139 is opposed to and against one of the second legs 56 of each of the blocks 140-143.

Figure 8:
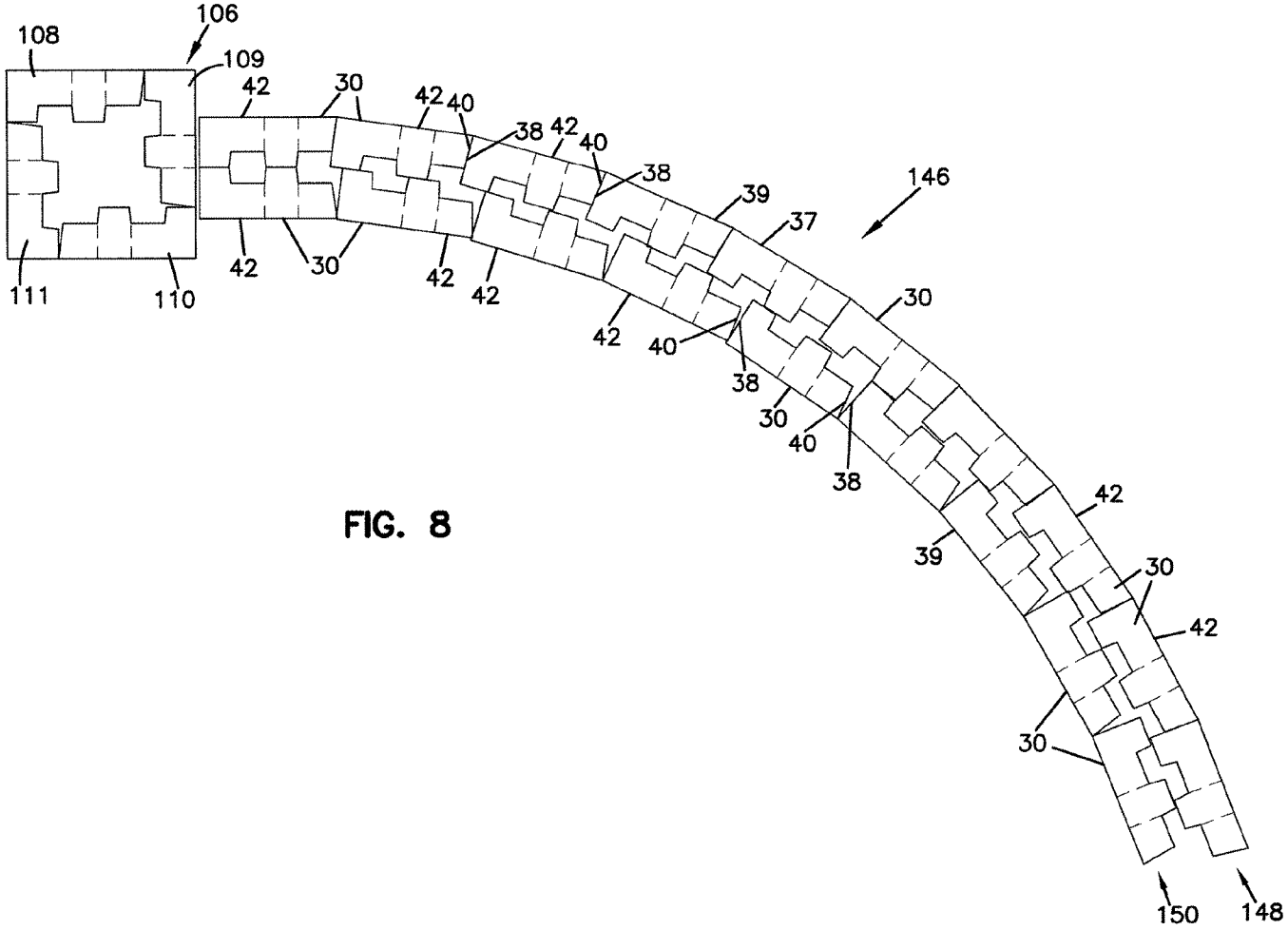
FIG. 8 is a top view of another embodiment of a column and wall that can be constructed with the block of FIG. 1.

FIG. 8 illustrates a top view of another embodiment of a combination column 106 and wall 146. The wall 146 in FIG. 8 is a curved wall 146. The taper of the second end face 40 allows for the blocks 30 to be arranged in curves without exposing any gaps between the blocks 30.

In FIG. 8, a first row 148 of blocks 30 is shown opposed to a second row 150 of blocks 30. In each of the rows, the blocks 30 are arranged adjacent to each other so that the respective first split face 42 of each block 30 is adjacent to and in alignment with the first split face 42 of the next adjacent block 30.

As can be seen in FIG. 8, the first row 148 forms a curve so that the outside curve is formed by the first split face 42. In that first row 148, the second end face 40 of each of the blocks 30 is engaged completely against the first end face 38, so that there are no gaps between them. Because of the taper on the second end face 40, when the first end face 38 of the next adjacent block 30 is pressed against it, a curve is formed along the first row 148 on the edge formed by the adjacent first split faces 42.

The second row 150 is arranged to be opposing the first row 148. The second end face 40 of one of the blocks 30 is adjacent to the first end face 38 of the next adjacent block 30 so that at least the adjacent corners are touching. To form a curve in the second row 150, the gap between adjacent second end faces 40 and first end faces 38 is not visible from outside of the wall. This forms the inside curve of the second row 150 along the first split faces 42 of the adjacent blocks 30.

Figure 9:
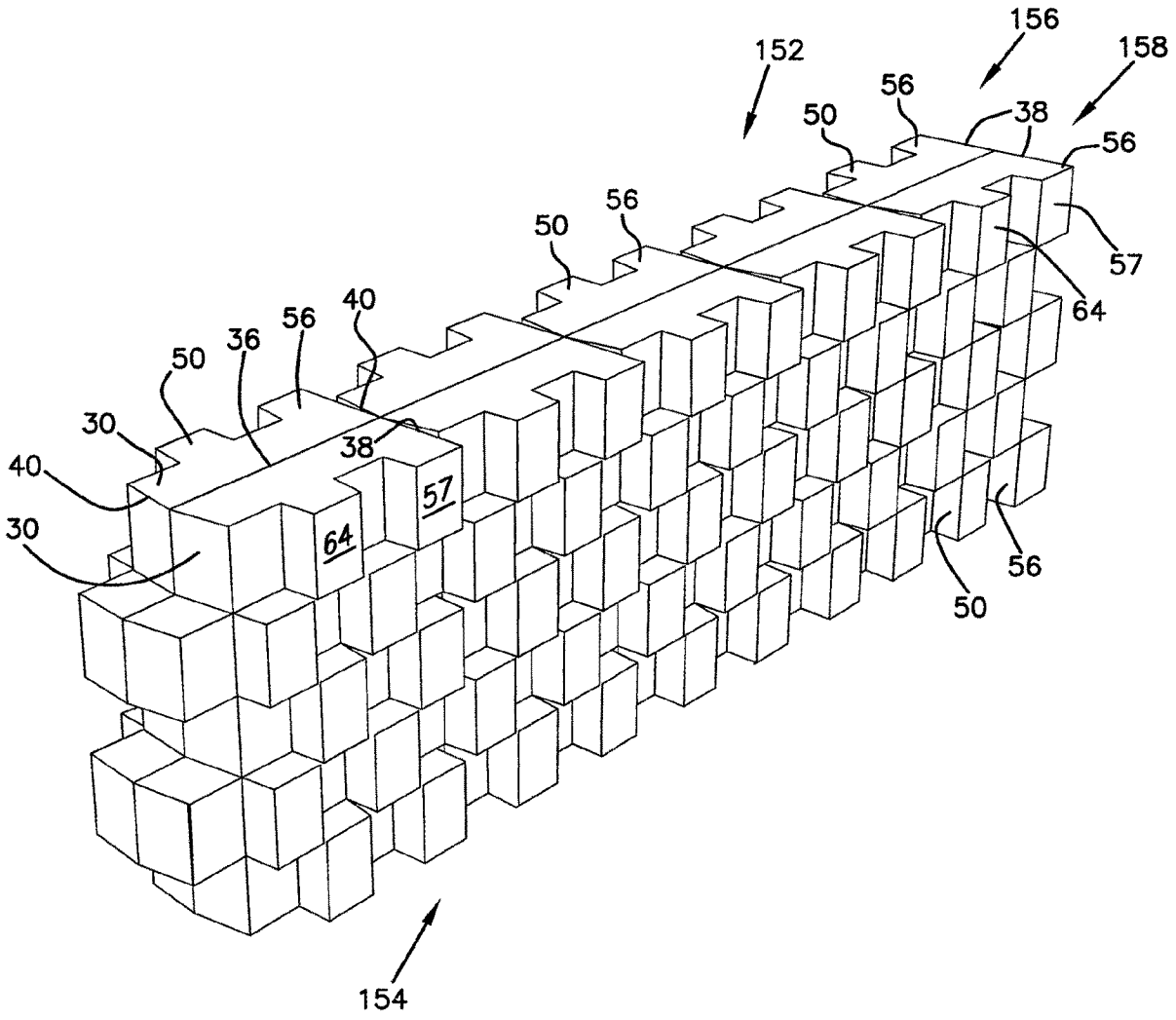
FIG. 9 is a perspective view of another embodiment of a wall that can be constructed with the block of FIG. 1.

FIG. 9 is a perspective view of another wall 152 that can be constructed from blocks 30 of FIG. 1. The wall 152 is a non-nested waffle face wall 154. The waffle face wall 154 is constructed by placing two rows 156, 158 of blocks 30 so that the second side 36 of each block 30 in the row 156 is against the second side 36 of each block 30 in the row 158. This results in the legs 50, 56 of each of the blocks 30 being directed outwardly, to be visible from the exterior of the wall 152. In the example shown in FIG. 9, the waffle face wall 154 has five courses with the blocks 30 of each course offset from the adjacent course by the width of one of the legs, 50, 56.

Figure 10:
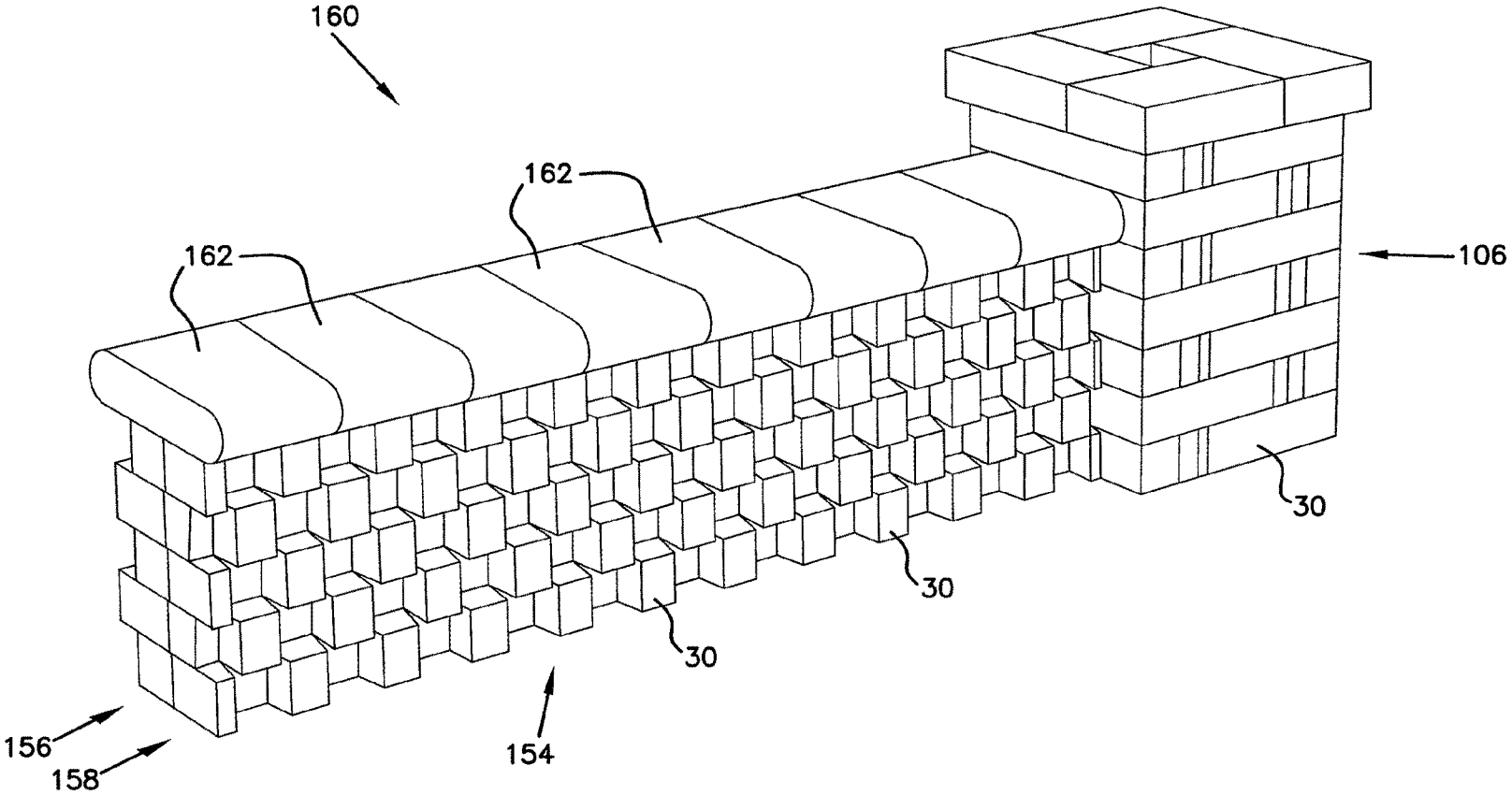
FIG. 10 is a perspective view of another embodiment of a column and wall that can be constructed with the block of FIG. 1.

FIG. 10 is a perspective view of a wall 160 including the waffle faced wall 154 adjacent the column 106. The wall 160 is finished with cap blocks 162, which cover the top of both of the opposing rows 156, 158.

Figure 11:
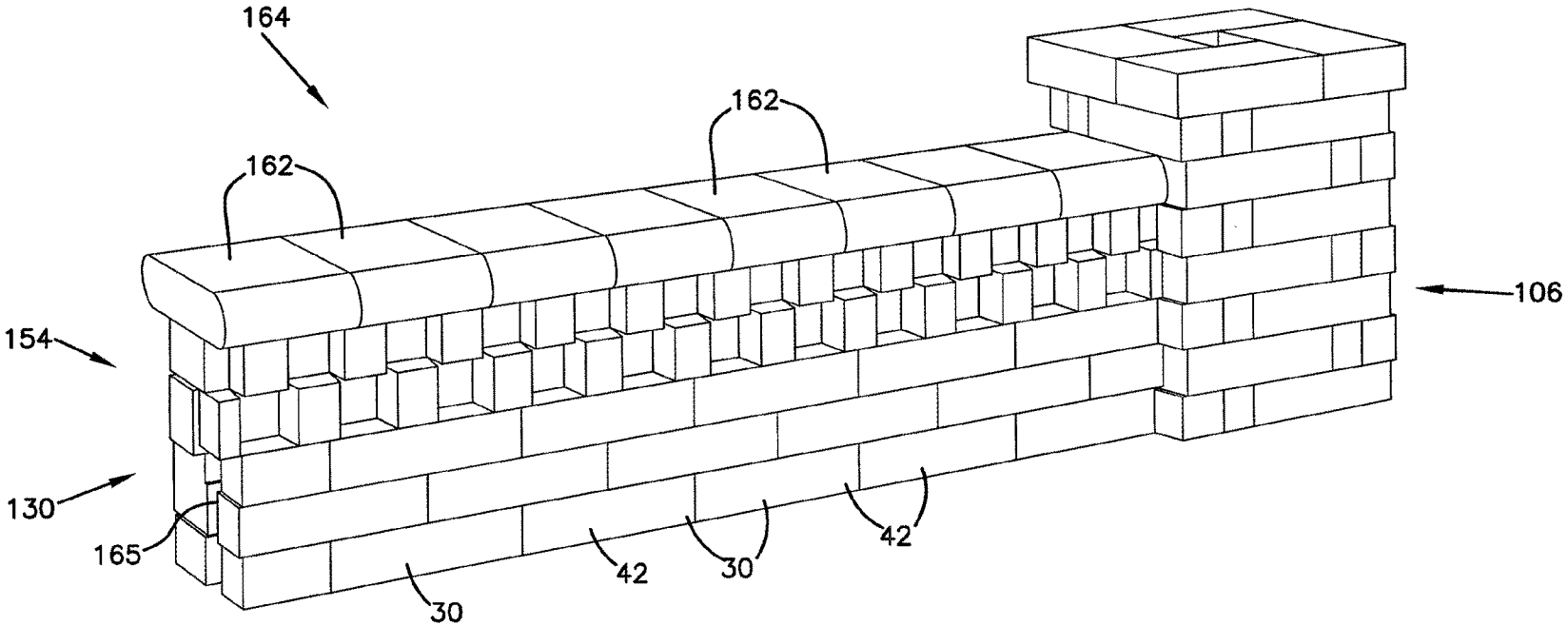
FIG. 11 is a perspective view of another embodiment of a wall and column that can be constructed with the block of FIG. 1.

FIG. 11 is a perspective view of a mixed face wall 164 constructed from the blocks 30. In this embodiment, the wall 164 includes a combination of both the wall 130 of FIG. 7 and the waffle faced wall 154 of FIG. 9. Many combinations are possible. In the example shown in FIG. 11, the bottom three courses 165 of the mixed face wall 164 is a wall 130 as shown in FIG. 7, in which the exterior appearance is relatively planar, with the first split face 42 of each of the blocks 30 being visible. The top two courses of the wall 164 are the waffle face 154, in which the legs 50, 56 are visible. Cap blocks 162 form the upper surface of the wall 164 and cover both opposing rows in the mixed face wall 164. The column 106 is adjacent and against the mixed face wall 164.

Figure 12:
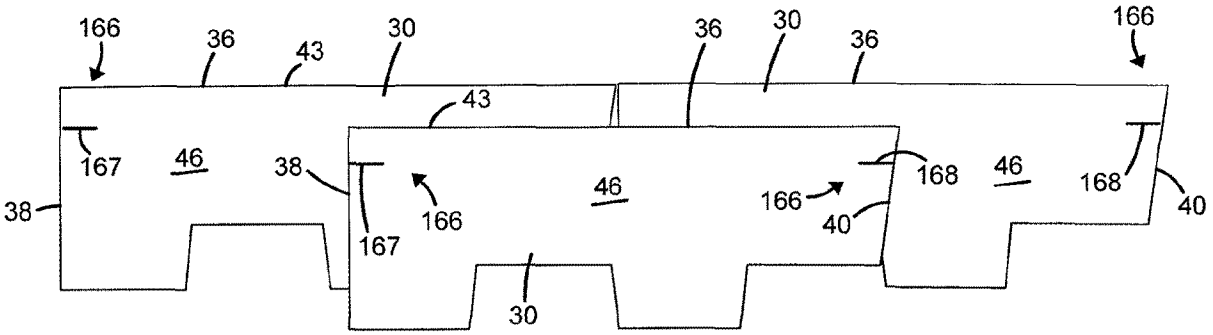
FIG. 12 is a top view of three of the blocks of FIG. 1 oriented in a configuration to form a retaining wall having a setback.

The block 30 can be used for making a small retaining wall (a garden wall). FIG. 12 shows a top view of three of the blocks 30 of FIG. 1 oriented in a configuration to form a retaining wall having a setback. The blocks 30 can be stacked in successive courses with a running bond and typically with some batter, which is a gradual upward and backward slope to assist the wall in resisting forces exerted on it by the retained soil. A setback can be used with each block 30 to assist in forming the desired batter.

Preferably, the block 30 includes no lips, tongues, "dogbones" or other integral "positive-interference" setback-establishing configurations. That is, the preferred block 30 is lip-free, tongue-free, dogbone-free, and other positive-interference-free. In lieu thereof, the block 30 includes a visual setback indicator 166. In general, the visual setback indicator 166 helps to guide the construction of a retaining wall to have a desired setback distance for successive courses of blocks in a wall constructed with the blocks 30.

In order to be easily used, the visual setback indicator 166 is on the upper face 46 of the block 30 and is so located as to provide a reference in relation to the lower front edge 43 (FIG. 1) of the block(s) 30 to be laid on the upper face 46. In contemplated embodiments, the visual setback indicators are easily visible to the installer during the installation process, and are located relative to each other so as to indicate the proper setback to the installer. Because most walls are built with a "running bond" pattern, the visual setback indicator includes visual portions on the upper face 46 near the edges where the upper face 46 meets the first and second end faces 38, 40.

A variety of embodiments for the visual setback indicator 166 are contemplated. In FIG. 12, the visual setback indicator 166 is shown as extending only partially across the upper face 46 in two sections 167, 168. The section 167 extends on the upper face 46 from the first end face 38. The second section 168 extends on the upper face 46 from the second end face 40. In this embodiment, the first and second sections 167, 168 are each less than one-third of the entire width across the upper face 46 at the location of the visual setback indicator 166.

B. The Second Embodiment of a Multi-Use Block, FIGS. 14-21

Figure 14:
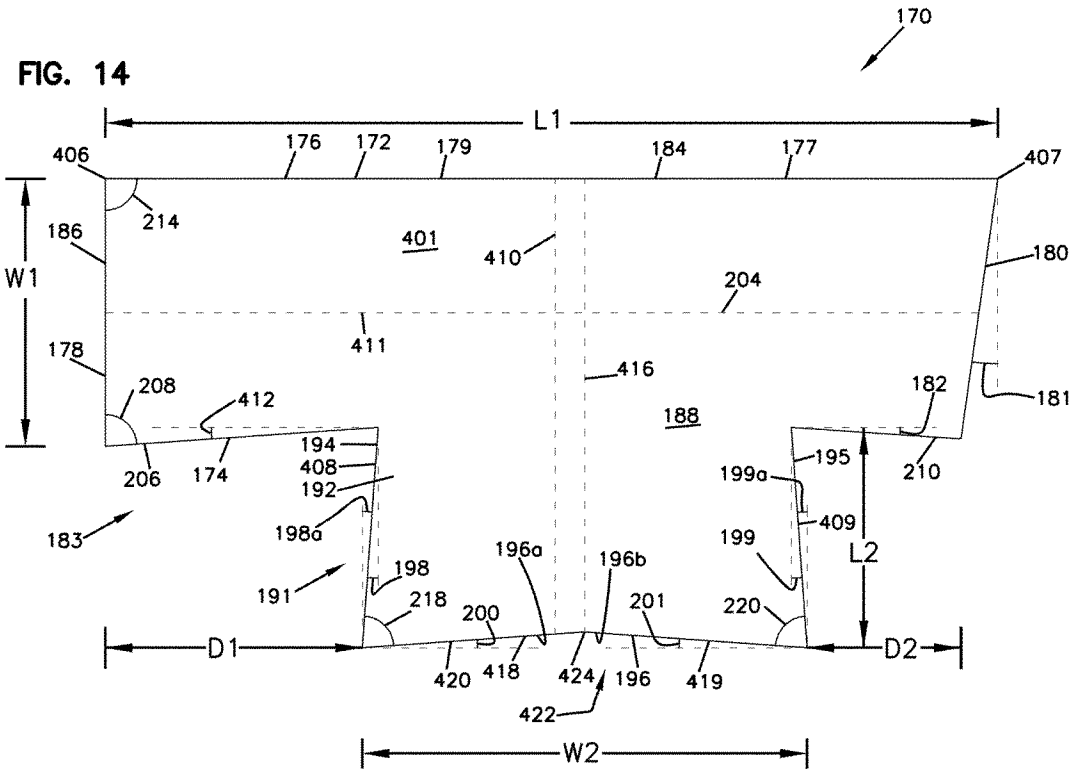
FIG. 14 is a top view of another embodiment of a multi-use concrete block, constructed in accordance with the principles of this disclosure.
Figure 15:
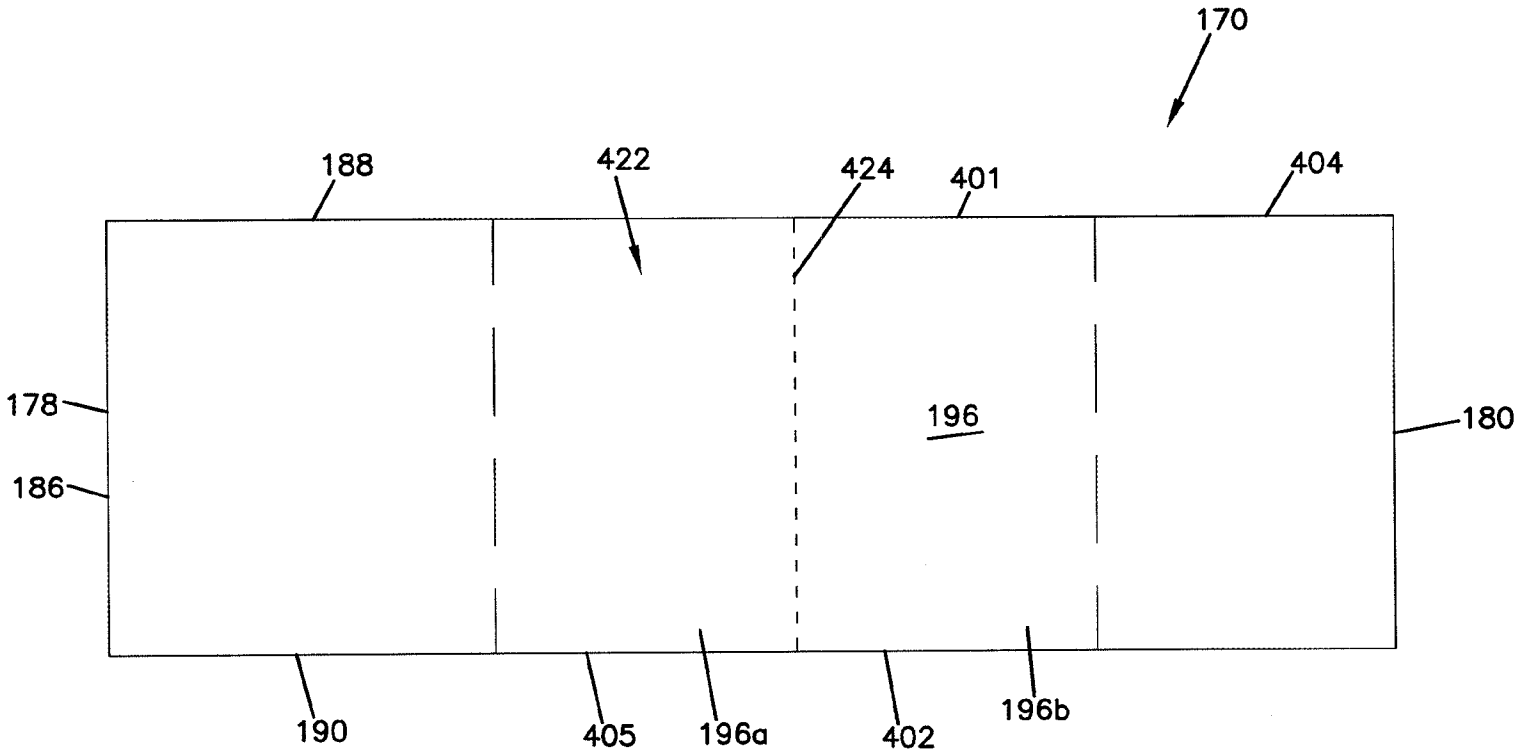
FIG. 15 is a front view of the block of FIG. 14.

(1) The Block, FIGS. 14 and 15

The second embodiment of a multi-use building block is illustrated in FIG. 14 at 170. Like the block of the first embodiment, the block 170 can be made of many different types of materials. When used as a block for construction of, e.g., walls and columns, it is typically made of concrete, preferably dry cast concrete but it can be made of wet cast concrete. The block 170 includes a body 172 having a length L1 and a width W1. The length L1 is longer than the width W1, so that the body 172 is elongate. The body 172 is "generally rectangular," as previously defined.

In other arrangements, the block 170, when utilized in, for example, casual furniture arrangements can be made from non-concrete materials. The non-concrete materials can include, for example, wood or plastic. Example plastics can include thermoset plastics, polystyrene, PVC; or other moldable material. In the embodiment of FIG. 14, the body 172 includes opposite first and second sides 174, 176, and opposite first and second end faces 178, 180 extending there between.

As characterized herein, the body 172 is tapered, in that it is longer at second side 176 than first side 174. In section (4) below, alternate characterizations of the body 172 are discussed. This taper can be achieved by setting one or both of the end faces 178, 180 at an angle 181 to the second side 176. The second end face 180 extends inwardly as it extends from the second side 176 to the first side 174. The angle 181 of the second end face 180 relative to the second side 176 will be less than 10 degrees, for example about 8 degrees. In this embodiment, the body 172 is tapered inwardly from end faces 178, 180 toward a leg 192, which will be explained further below.

In some methods of making the block 170, the resulting second side 176 will be a first split face 184, and the first end face 178 will be a second split face 186. An example method of making will be described further below in connection with FIG. 21.

In some uses of the block 170, the second side 176 will be a front section having a front face 179. In some structures, the front face 179 will be exposed when the block 170 is assembled with like blocks 170 in a structure. The first and second end faces 178, 180 extend rearwardly from the front face 179. The block 170 will have a rear section 183 formed integrally with the front section 177.

The block 170 further includes an upper face 188 and a lower face 190 (FIG. 14). Preferably, the upper face 188 and lower face 190 are generally planar and parallel to each other. In this example, the block 170 is free of through-holes or cores, although it could be made with such voids.

The block 170 includes at least a first leg portion 191, which can be part of the rear section 183. The first leg portion 191 is leg 192. As characterized herein, the leg 192 extends from the first side 174 of the body 172. Alternate definitions are included in section (4) below. The leg 192 is generally rectangular, but in preferred embodiments, deviates from a rectangular shape as can be seen in FIG. 14. The leg 192 includes opposite leg sides 194, 195. The opposite leg sides 194, 195 extend between an end leg face 196 and the first side 174 of the body 172. In this embodiment, the leg sides 194, 195 are angled (or tapered) away from each other as they extend away from the body 172 and toward the end leg face 196. The angle is shown at 198 for leg side 194 and is less than 10 degrees, for example, about 4 degrees. The leg side 195 is also angled at angle 199, which is the same angle as angle 198.

The end leg face 196 includes a recessed portion. For example, the end leg face 196 has a section 196*a* recessed inwardly from the leg side 194 at an angle 200 of less than 10 degrees, for example about 4 degrees. Similarly, the end leg face 106 has a section 196*b* recessed inwardly from leg side 195 at angle 201, which is the same angle as angle 200.

The leg 192 has a center line 202 which is perpendicular to the center line 204 of the body 172. The leg 192 has a width W2, which is parallel to the length L1 of the body 172. The width W2 is the widest portion of the leg 192, measured at the end leg face 196, in this embodiment. Further, the leg 192 includes a length L2, perpendicular to the length L1 of the body 172. The length L2 is the greatest length of the first leg 192, as measured from the body 172 to an end point of one of the leg sides 194, 195.

The leg 192 of the block 170 is the only leg on the block 170. In this example, the leg 192 is spaced from each of the first end face 178 and second end face 180.

In the embodiment shown in FIG. 14, the leg 196 is spaced from the first end face a distance D1, and spaced from the second end face 180 a distance D2, in which D1 is greater than D2.

Still in reference to FIG. 14, the first side 174 includes first portion 206, which is between the first end face 178 and the leg side 194. This first portion 206 is at a non-perpendicular angle 208 relative to the first end face 178 and to the leg side 194. For example, the angle 208 between first portion 206 and first end face 178 is less than 90 degrees, for example about 86 degrees. As can be seen, the first portion 206 of the first side 174 angles inwardly (i.e., tapers inwardly) as it extends from the first end face 178 to the leg side 194.

Similarly, the first side 174 has a second portion 210. The second portion 210 extends between the second end face 180 and the leg side 195. The second portion 210, in this example, is angled at a non-perpendicular angle 212 between the second end face 180 and the second portion 210. The angle 212 will be greater than 90 degrees, for example about 94 degrees. As can be seen, the second portion 210 tapers inwardly at an angle 182 as it extends from the second end face 180 to the leg side 195. The angle 182 will be less than 10 degrees, for example, about 4 degrees.

The angle 198 of the leg side 194, the angle 200 of the end leg face section 196*a*, the angle 198 of leg side 195, the angle 200 of the end leg face section 196*b* and the angle 182 of the second side portion 210 are the same. These relationships are helpful when constructing a column 252 (FIGS. 16 and 17) to help lock the blocks 170 together to prevent any one of the blocks 170 from moving laterally relative to the others. There is a similar locking relationship between second portion 210 of the first side 174 and the leg side 194. A steady, linear taper shown by angles 182, 198 and 200 can also be stepped or curvilinear to be helpful in resisting pullout of the leg 192 from between two adjacent units in the same course.

In one useful example, the block 170 will have a length L1 of less than 13 inches, for example about 11.8-12 inches. The width W1 will be 3-4 inches, for example about 3.6 inches. The length L2 will be less than 4 inches, for example about 2.8-3 inches. The length of D1 will be between 3 and 4 inches, for example about 3.4 inches, while the length of D2 will be less than 3 inches, for example about 2-2.1 inches. The angle 214 will be about 90 degrees, while the angle 216 will be about 82 degrees. The angles 218 and 220 will each be about 82 degrees. The height between the upper face 188 and lower face 190 will be less than 5 inches, for example about 4 inches.

Figure 21:
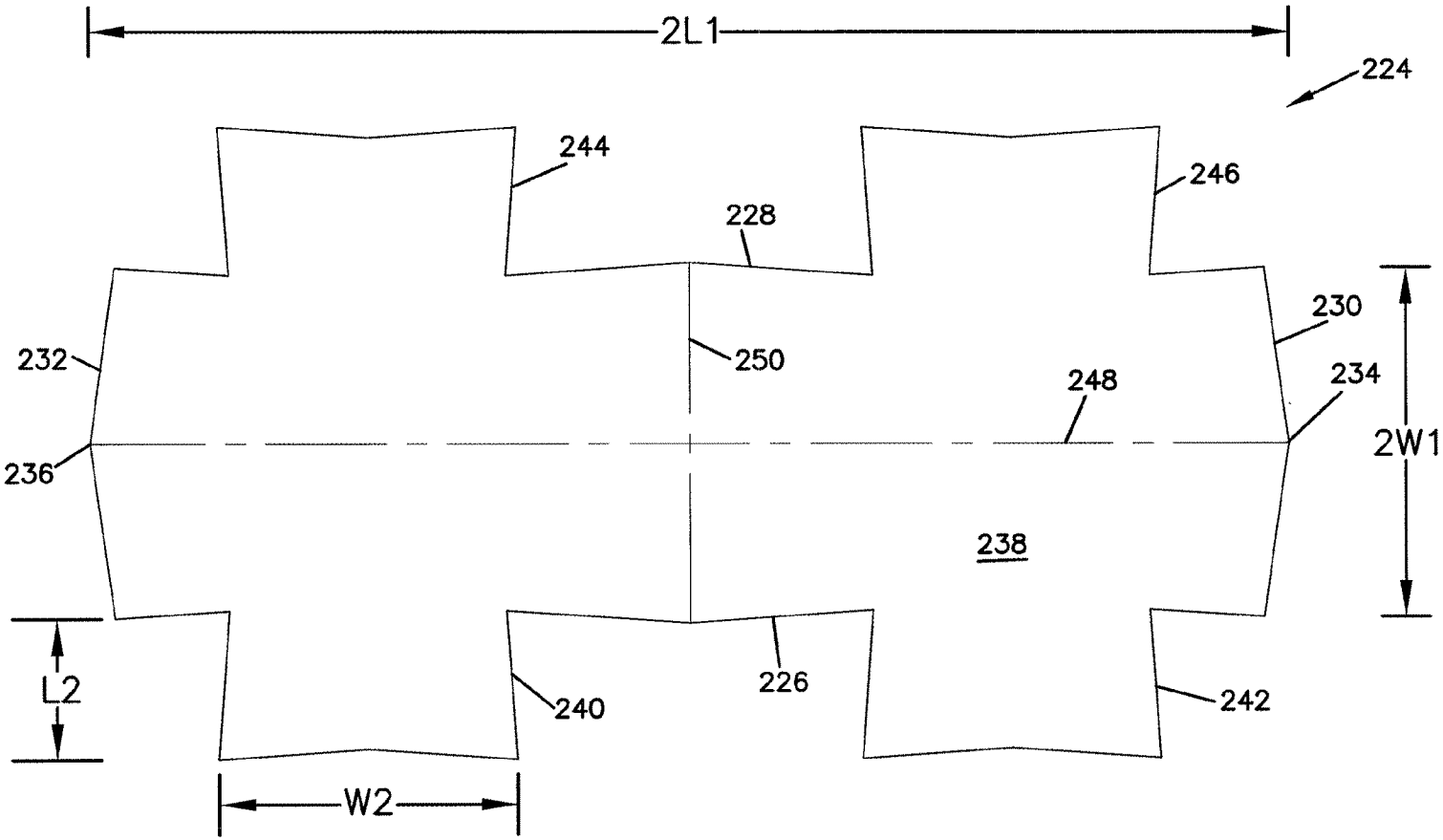
FIG. 21 is a top view of one embodiment of a pre-split concrete body used in making the block of FIG. 14.

(2) Example Method, FIG. 21

Before turning to various freestanding walls, columns, and other structures that can be made with the block 170, attention is directed to FIG. 21, which illustrates one method for making the block 170, when made from concrete. In FIG. 21, a pre-split body is shown at 224. The pre-split body 224 can be made as a result of molding dry cast concrete. The pre-split body 224 has a length 2L1 and a width 2W1 and, the pre-split body 224 (without the legs 240, 242, 244, 246) is generally rectangular.

The pre-split body 224 includes a first side 226 and an opposite second side 228. Extending between the first side 226 and second side 228 are opposite first and second end walls 230, 232.

In the example shown in FIG. 21, the first end wall 230 tapers from a center 234 inwardly as the end wall 230 extends from the center 234 to each of the first side 226 and second side 228. Similarly, the second end wall 232 tapers inwardly as it extends from a center 236 to the first side 226 and second side 228.

The pre-split body 224 will have a generally planar upper face 238 and lower face. The upper face 238 and lower face will be generally parallel to each other.

Still in reference to FIG. 21, at least a first leg 240 and second leg 242 extend from the first side 226 of the pre-split body 224. Each of the legs 240, 242 has a width W2 parallel to the length 2L1 of the pre-split body 224, and a length L2 perpendicular to the length 2L1 of the pre-split body 224. The legs 240, 242 are generally rectangular.

The pre-split body 224 further includes a first leg 244 and second leg 246 extending from the second side 228 of the pre-split body 224. The first leg 244 and second leg 246 will generally be the same size as the first leg 240 and second leg 242 and have their center lines perpendicular to the center line of the pre-split body 224.

To make the block 170 of FIG. 14, the method includes splitting the concrete pre-split body 224 along the length at splitting line 248 and along the width at splitting line 250 to result in four multi-use blocks 170 (FIG. 14). The resulting four multi-use blocks 170 will each have a body 172 with length L1 and width W1, and first split face 184, created along the splitting line 248 and second split face 186 created along the splitting line 250. The second split face 186 will be generally perpendicular to the first split face 184.

The step of splitting can include, first, splitting the pre-split body 224 along the splitting line 250, which is along the width 2W1, to result in a first and second split block, with each split block having a length of one-half of 2L1, which would be L1. After that step, then the first split block and second split block can be split along the splitting line 248, which is along the length L1, to result in the four multi-use blocks 170.

A variety of techniques for splitting the pre-split body 224 can be used. For example, in one method, the step of splitting along the splitting line 250 across the width 2W1 uses a basic splitting technique, while the step of splitting along the split line 248 across the length is done in accordance with U.S. Pat. No. 8,327,833, which is incorporated herein by reference.

(3) Structures Made with the Embodiment of FIGS. 14-15: FIGS. 16-20

The block 170, when made from concrete, can be used to make a variety of freestanding walls, garden walls, edging walls, single course edging, columns, and other structures. The structures can be made to have aesthetically pleasing exterior appearances.

Figure 16:
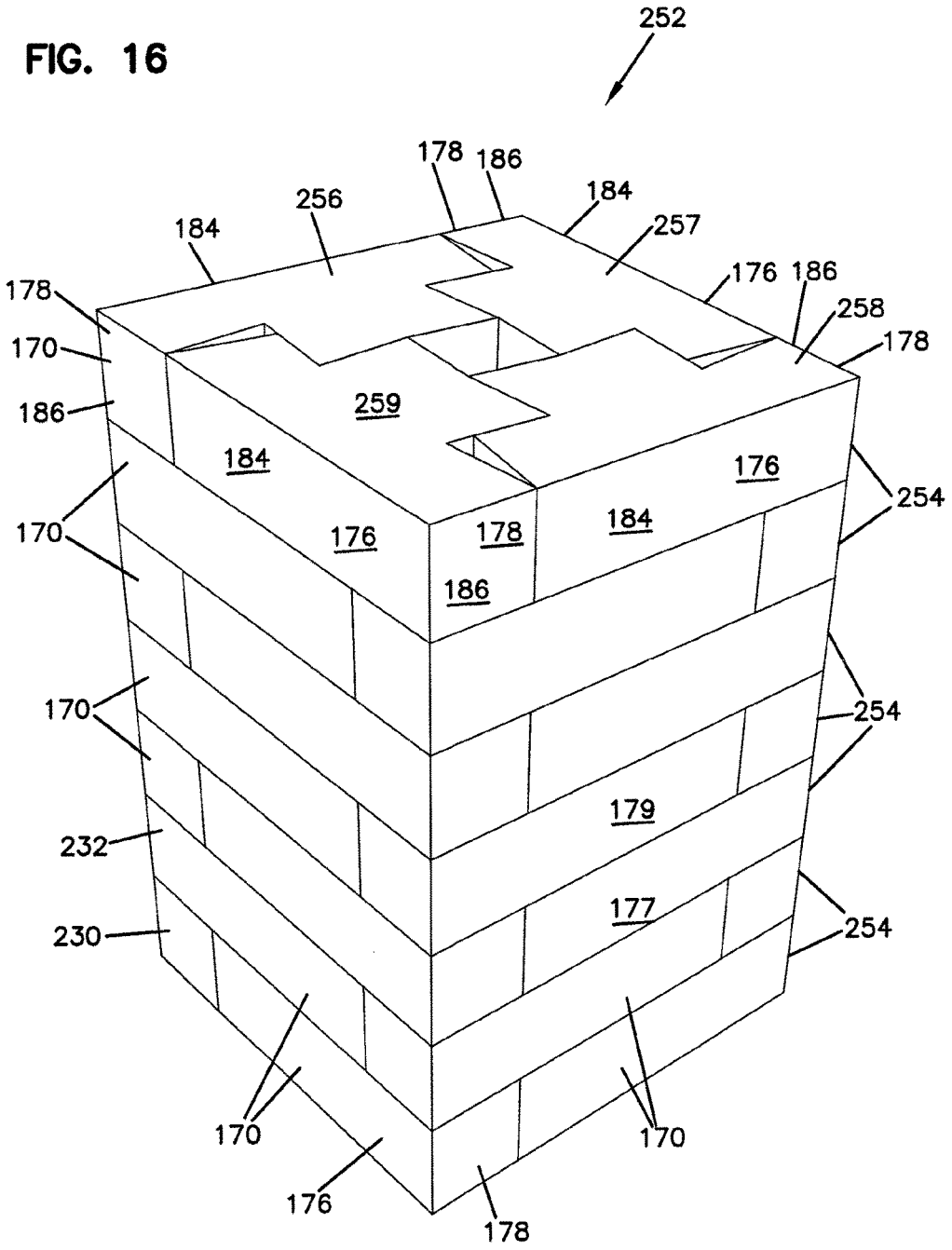
FIG. 16 is a perspective view of one embodiment of a column that can be constructed with the block of FIG. 14.
Figure 17:
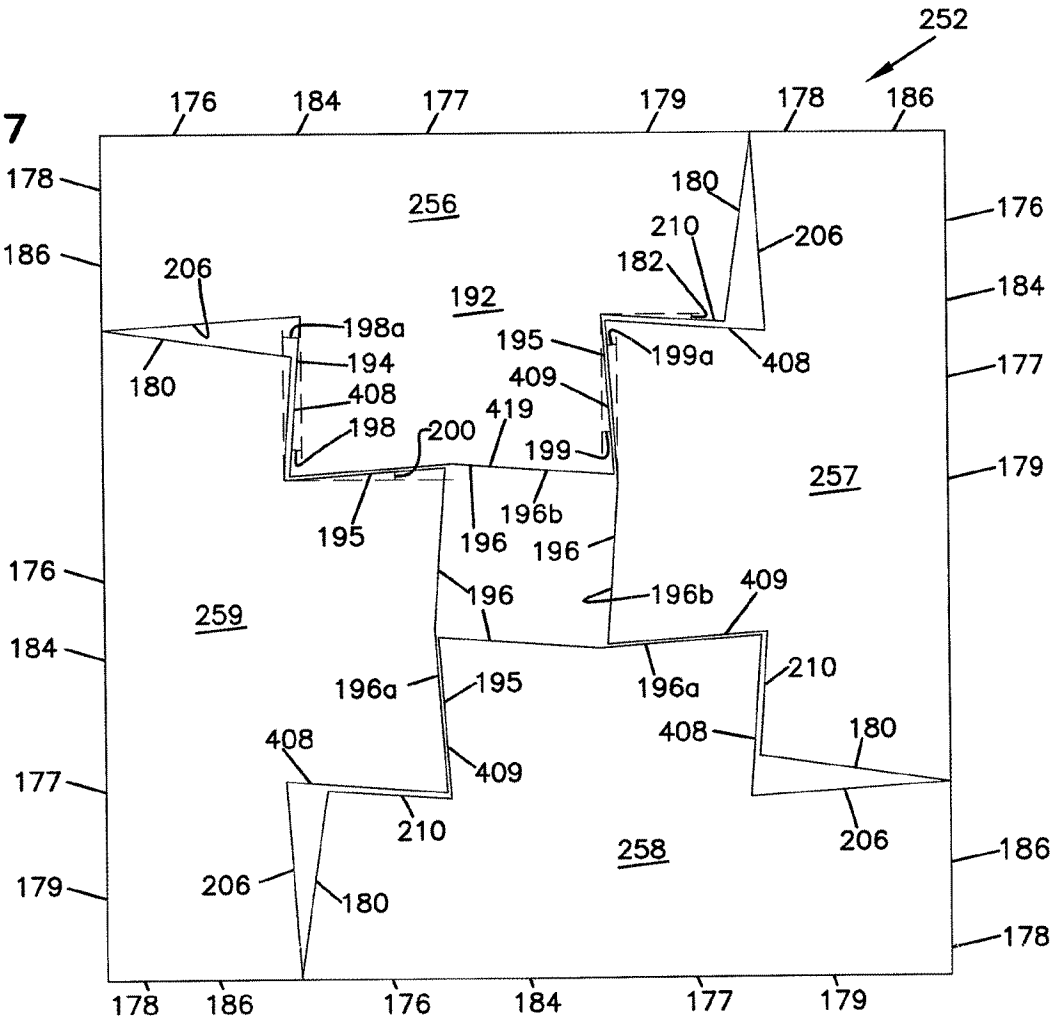
FIG. 17 is a top view of the column of FIG. 16.

FIG. 16 illustrates one example column 252 that can be constructed from the block 170. FIG. 17 shows a top view of the column of FIG. 16. The column 252 includes a plurality of courses 254 of the blocks 170. In the example shown, there are four blocks 170 in each course 254. In the top course, the four blocks 170 are shown at 256, 257, 258, and 259.

The column 252 is formed so that the exterior surfaces are all either the first split face 184 or second split face 186, to give the column 252 an attractive exterior appearance.

In one example, the column 252 is formed by starting with one of the blocks, for example the first block 256, and then laying the second block 257 adjacent to it, such that the second split face 186 of the block 257 is in alignment with the first split face 184 of the first block 256. The second end face 180 of the block 256 will abut the first portion 206 of the first side 174 of the block 257. Next, the third block 258 is laid adjacent to the second block 257, such that the second split face 186 of the third block 258 is adjacent and in alignment with the first split face 184 of the second block 257. The second end face 180 of the second block 257 abuts the first portion 206 of the third block 258. The third block 258 is generally opposite the first block 256. Finally, the fourth block 259 is laid between the first block 256 and the third block 258, such that the second split face 186 of the fourth block 259 is adjacent and in alignment with the first split face 184 of the third block 258. Because of the angles of the sides 194 and 195 of the leg 192, the fourth block 259 must be moved into the position illustrated in FIG. 16 from above the other blocks. The first split face 184 of the fourth block 259 is then adjacent and in alignment with the second split face 186 of the first block 256. The first portion 206 of the fourth block 259 abuts the second end face 180 of the third block 258. Further, the second end face 180 of the fourth block 259 abuts the first portion 206 of the first block 256. The angles 198 of the leg sides 194 and 195 of each block 256-259 are the same as the angles 182 of the second portion 210 and the angles 200 of each section **196*a*, 196*b* of the end leg face 196. As a result, when the blocks 256-259 are placed as illustrated in FIG. 16, they lock the four blocks 256-259** together so they cannot be moved laterally. Optionally, the courses can be glued together with a suitable adhesive, to increase the stability and integrity of the structure.

Figure 18:
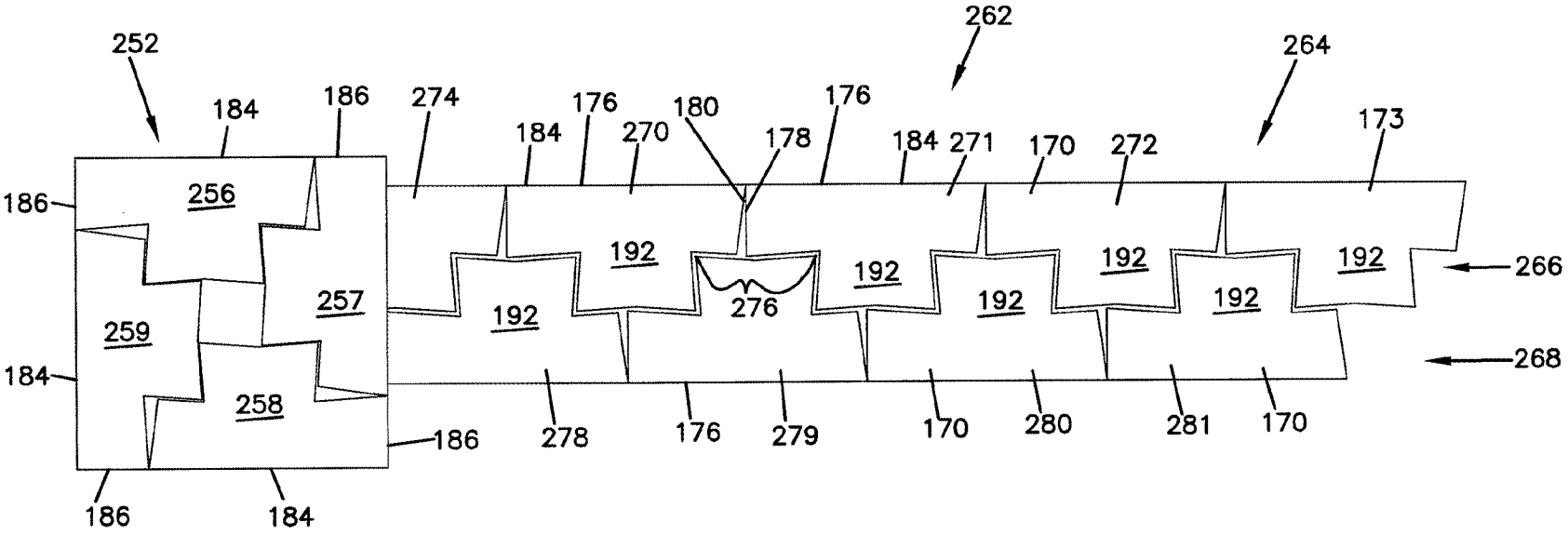
FIG. 18 is a top view of one embodiment of a column and wall that can be constructed with the block of FIG. 14.

FIG. 18 illustrates the top view of a combination column 252 and freestanding wall 262. The wall 262 is abuts the column 252. The wall 262 is made from the blocks 170 in a nested formation 264. By "nested" it is meant that when two of the blocks 170 are placed end-to-end with their legs 192 pointing in the same direction, a space is created between the adjacent legs 192 of the two blocks, which receives the leg 192 of a third like block.

In FIG. 18, a first row of blocks is shown at 266, while a second row of blocks 268 is shown opposing and nested with the first row of blocks 266. The first row of blocks 266 includes blocks 270, 271, 272, and 273 arranged end-to-end, such that the first split face 184 of each of the blocks is adjacent and in alignment with the first split face 184 of the next adjacent block to form a generally straight line. It should be noted that row 266 also includes a half block 274. A splitting groove may be made across the middle of the upper or lower face 188, 190 of the block 170 to facilitate the splitting to form the half block 274 when one is needed.

The second end face 180 of each block 170 abuts the first end face 178 of the adjacent block.

When the blocks 270-273 and half block 274 are arranged end-to-end, in the first row 266, receiving spaces 276 are created to receive the legs 192 of blocks 278, 279, 280, 281 making up the second row 268. The blocks 278-281 are arranged end-to-end, as described for the first row 266.

As can be seen in FIG. 18, the leg 192 of the block 278 is received within the receiving space 276 between blocks 274 and 270. The leg 192 of the block 270 is received in the receiving space 276 between blocks 278 and 279. The leg 192 of the block 271 is received within the receiving space 276 between the blocks 279 and 280. The pattern continues throughout the wall 262. In the wall 264, the angled leg sides 194 and 195 of a block interlock with the angled leg sides 194, 195 of two other blocks on the opposite side of the wall 262 and prevent the block from being pulled out laterally.

Figure 19:
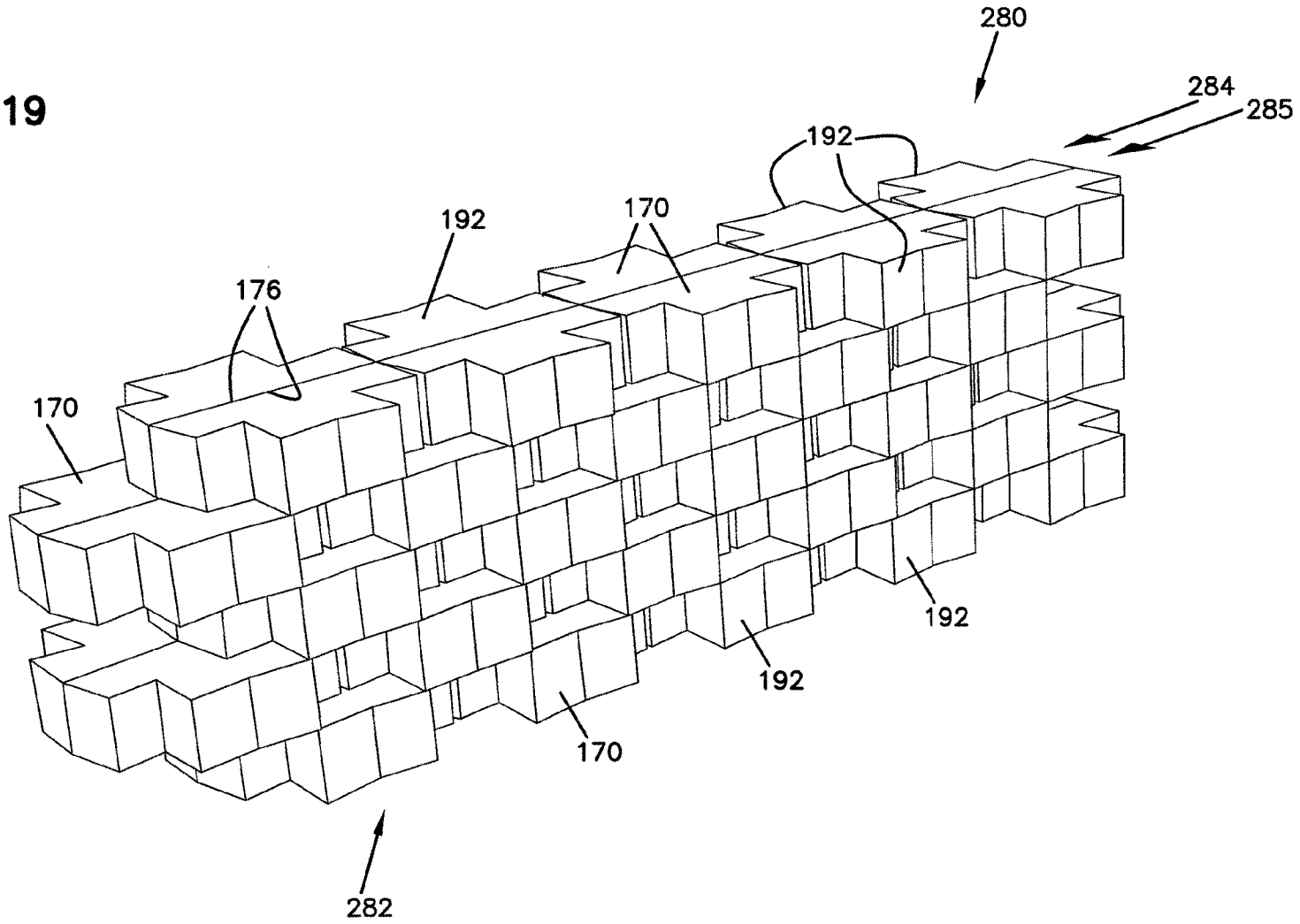
FIG. 19 is a perspective view of one embodiment of a wall that can be constructed with the block of FIG. 14.

FIG. 19 is a perspective view of another wall 280 that can be constructed from the blocks 170 of FIG. 14. The wall 280 is a non-nested waffle face wall 282. The waffle face wall 282 is constructed by placing two rows 284, 285 of the blocks 170 so that the second side 176 of each block 170 in the row 284 abuts the second side 176 of the block 170 in the row 285. This results in the legs 192 of each of the blocks 170 being directed outwardly, to be visible from the exterior of the wall 280. In the example shown in FIG. 19, the waffle face wall 282 has five courses.

Figure 20:
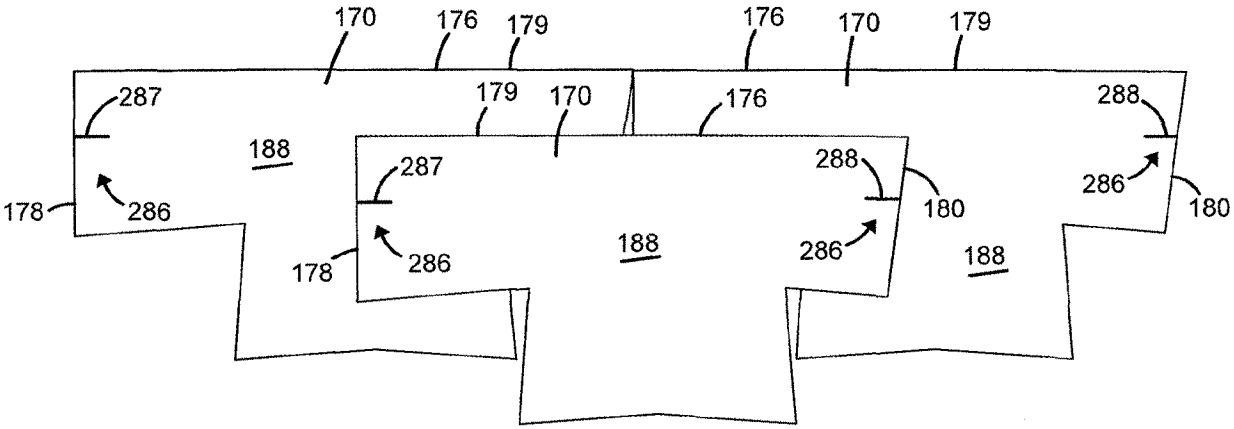
FIG. 20 is a top view of 3 of the blocks of FIG. 14 oriented in a configuration to form a retaining wall having a setback.

The block 170 can be used for making a small retaining wall (a garden wall). FIG. 20 shows a top view of three of the blocks 170 of FIG. 14 oriented in a configuration to form a retaining wall having a setback. The blocks 170 can be stacked in successive courses with a running bond and typically with some batter, which is a gradual upward and backward slope to assist the wall in resisting forces exerted on it by the retained soil. A setback can be used with each block 170 to assist in forming the desired batter.

Preferably, the block 170 includes no lips, tongues, "dogbones" or other integral "positive-interference" setback-establishing configurations. That is, the preferred block 170 is lip-free, tongue-free, dogbone-free, and other positive-interference-free. In lieu thereof, the block 170 includes a visual setback indicator 286. In general, the visual setback indicator 286 helps to guide the construction of a retaining wall to have a desired setback distance for successive courses of blocks in a wall constructed with the blocks 170.

In order to be easily used, the visual setback indicator 286 is on the upper face 188 of the block 170 and is so located as to provide a reference in relation to a lower front edge of the block(s) 170 to be laid on the upper face 188. In contemplated embodiments, the visual setback indicators are easily visible to the installer during the installation process, and are located relative to each other so as to indicate the proper setback to the installer. Because most walls are built with a "running bond" pattern, the visual setback indicator includes visual portions on the upper face 188 near the edges where the upper face 188 meets the first and second end faces 178, 180.

A variety of embodiments for the visual setback indicator 286 are contemplated. In FIG. 20, the visual setback indicator 286 is shown as extending only partially across the upper face 188 in two sections 287, 288. The section 287 extends on the upper face 188 from the first end face 178. The second section 288 extends on the upper face 188 from the second end face 180. In this embodiment, the first and second sections 287, 288 are each less than one-third of the entire width across the upper face 188 at the location of the visual setback indicator 286.

(4) Additional Observations re the Embodiment of FIGS. 14-21

In addition to the characterizations above, additional observations and/or alternate definitions regarding the block 170 embodiment of FIGS. 14-21 are included herein.

Referring to FIG. 14, the block body 172 includes opposite first and second sides 174, 176, and opposite first and second end faces 178, 180 extending therebetween.

The body 172 further has opposite first and second bearing faces 401, 402 (FIG. 15). The first and second bearing faces 401, 402 extend between the first and second sides 174, 176 and between the first and second end faces 178, 180. In normal use, when the block 170 is used for construction of structures such as freestanding walls, garden walls, edging walls, single course edging, columns, etc., the first bearing face 401 is the upper face 188 in use. The second bearing face 402 is the lower face 190.

The first bearing face 401 has a contact surface portion 404. The contact surface portion 404 is the part of the first bearing face 401 that is in touching engagement with a like block 170 stacked on the first bearing face 401. In one or more example embodiments, the contact surface portion 404 is the outermost projecting part of the first bearing face 401. In preferred embodiments, the contact surface portion 404 is generally planar. By "generally planar", it is meant that the surface forms a plane but can have some minor deviations.

The second bearing face 402 has a contact surface portion 405. The contact surface portion 405 is the part of the second bearing face 402 that is in touching engagement with either the ground or with the contact surface portion 404 of the first bearing face 401 of the like block 170, when stacked on the first bearing face 401 of the like block 170. In one or more example embodiments, the contact surface portion 404 is the outermost projecting part of the second bearing face 402. In preferred embodiments, the contact surface portion 405 is generally planar. In one or more example embodiments, the contact surface portion 404 of the first bearing face 401 and the contact surface portion 405 of the second bearing face 402 are generally parallel to each other.

The second side 176 of the body 172 has first and second opposite ends 406, 407. The second side 176 defines a second side center plane 410 that is generally orthogonal to the first and second bearing faces 401, 402.

An end face center plane 411 that is generally orthogonal to the first and second bearing faces 401, 402 extends between the end faces 178, 180. The end face center plane 411 is generally orthogonal to the second side center plane 410. In one or more embodiments, the end face center plane 411 contains the centerline 204 of the body 172.

In reference again to FIG. 14, the first side 174 of the body 172 defines leg 192. As such, the first side 174 of the body has the opposite leg sides 194, 195 and leg end face 196. The leg side 194 corresponds to a first leg side 408, while the opposite leg side 195 corresponds to second leg side 409. The leg end face 196 extends between the first leg side 408 and second leg side 409.

The first side 174 of the body 172 has the first portion 206. The first portion 206 extends between the first end face 178 and the first leg side 408.

Preferably, the first portion 206 is angled at a first extension angle 412 away from the second side 176 of the body 172, as the first portion 206 extends from the first leg side 408 to the first end face 178, the first extension angle 412 being non-zero. By the term, "extension angle", it is meant the angle measured when a straight line is drawn between endpoints, here the endpoints being: (i) the "intersection" of the first leg side 408 and first portion 206, and (ii) the "intersection" of the first end face 178 and first portion 206; but "extension angle" does not require the surface (here, the first portion 206) between the end points to be straight or planar. Rather, the surface between the end points can be curved, jagged, indented, protruding, etc. As used herein, by the term "intersection", it is meant the midpoint between the joining surfaces, such that if the intersection is radiused, the endpoint is taken at the midpoint of the radius.

The first extension angle 412 is measured relative to a line parallel to the end face center plane 411. The first extension angle 412 can be less than 10 degrees in some embodiments; less than 9 degrees in some embodiments; less than 8 degrees in some embodiments; less than 7 degrees in some embodiments; less than 6 degrees in some embodiments; less than 5 degrees in some embodiments. The first extension angle 412 can be greater than 1 degree in some embodiments; greater than 2 degrees in some embodiments; greater than 3 degrees is some embodiments; and greater than 4 degrees in some embodiments. In one or more example embodiments, the first extension angle 412 can be 2-7 degrees; and in one or more example embodiments, the first extension angle 412 can be 3-5 degrees. In one or more example embodiments, the first extension angle 412 can be about 4 degrees.

The first side 174 of the body 172 has the second portion 210 extending between the second end face 180 and the second leg side 409.

Preferably, the second portion 210 is "angled" at a second extension angle, also corresponding to the angle 182 shown in FIG. 14, away from the second side 176 of the body 172, as the second portion 210 extends from the second leg side 409 to the second end face 180, the second extension angle 182 being non-zero. As above, the term, "extension angle", means the angle measured when a straight line is drawn between endpoints, here the endpoints being: (i) the intersection of the second leg side 409 and second portion 210, and (ii) the intersection of the second end face 180 and second portion 210; but "extension angle" does not require the surface (here, the second portion 210) between the end points to be straight or planar.

The second extension angle 182 is measured relative to a line parallel to the end face center plane 411. The second extension angle 182 can be about equal to or different from the first extension angle 412. The second extension angle 182 can be less than 10 degrees in some embodiments; less than 9 degrees in some embodiments; less than 8 degrees in some embodiments; less than 7 degrees in some embodiments; less than 6 degrees in some embodiments; less than 5 degrees in some embodiments. The second extension angle 182 can be greater than 1 degree in some embodiments; greater than 2 degrees in some embodiments; greater than 3 degrees is some embodiments; and greater than 4 degrees in some embodiments. In one or more example embodiments, the second extension angle 182 can be 2-7 degrees; and in one or more example embodiments, the second extension angle 182 can be 3-5 degrees. In one or more example embodiments, the second extension angle 182 can be about 4 degrees.

The leg 192 is preferably narrower proximal the first portion 206 and second portion 210 of the first side 174 of the body 172 than at the leg end face 196. By the term "narrower", it is meant that: (i) a greatest distance between the first leg side 408 and second leg side 409 is less at the location where the leg 192 projects from the first portion 206 and second portion 210 than (ii) a greatest distance between the first leg side 408 and second leg side 409 at (adjacent to) the leg end face 196.

Alternately phrased, the leg 192 is narrower at its proximal end than at its distal end 419. The proximal end is closer to the second side 176 of the body 172 than the distal end 419, and the distal end 419 defines a free end 420 of the leg 192. The free end 420 of the leg 192 defines the leg end face 196. The proximal end of the leg 192 is the part of the leg that projects from the first portion 206 and second portion 210.

In preferred embodiments, the leg 192 has a widest portion 418 being at the leg end face 196. By "widest", it is meant that (i) a shortest distance between the first leg side 408 and second leg side 409 at (adjacent to) the leg end face 196 is greater than (ii) a shortest distance between the first leg side 408 and second leg side 409 along any other part of the leg 192.

The leg 192 has a center plane 416 that is generally orthogonal to the first and second bearing faces 401, 402. The center plane 416, in one or more example embodiments, can bisect the leg 192. In FIG. 14, the center plane 416 contains the leg center line 202.

As can be seen in FIG. 14, the leg 192 extends generally transverse to a remaining portion of the body 172. By "transverse", it is meant the center plane 416 of the leg 192 crosses the end face center plane 411. While the center plane 416 of the leg 192 need not be orthogonal to the end face center plane 411, in one or more example embodiments, the leg center plane 416 is orthogonal to the end face center plane 411.

An example of the leg 192 being narrower proximal the first portion 206 and second portion 210 includes the first leg side 408 diverging from the second leg side 409, as the first leg side 408 extends away from the first portion 206 of the first side 174 of the body 172. In one or more example embodiments, the first leg side 408 extends away from the first portion 206 at a third extension angle, corresponding to angle 198 in FIG. 14, relative to the leg center plane 416. The third extension angle 198 will be non-zero. The term "extension angle" is as used above, and refers to measurement of a line drawn between endpoints. In this case, the endpoints are at the intersection of: (i) first portion 206 and first leg side 408; and (ii) first leg side 408 and leg end face 196. The term "extension angle" does not require the surface between the end points to be straight or planar.

An extension angle **198*a* is also illustrated as being the extension angle of the first leg side 408 extending from leg end face 196 to the first portion 206. The extension angle 198*a* will be the same measurement as the third extension angle 198**.

The second leg side 409 diverges from the first leg side 408, as the second leg side 409 extends away from the second portion 210 of the first side 174 of the body 172. In one or more example embodiments, the second leg side 409 extends away from the second portion 210 at a fourth extension angle 199 in FIG. 14, relative to the leg center plane 416. The fourth extension angle 199 will be non-zero. The term "extension angle" is as used above, and refers to measurement of a line drawn between endpoints. In this case, the endpoints are at the intersection of: (i) second portion 206 and second leg side 409, and (ii) second leg side 409 and leg end face 196; although, again, as stated above, "extension angle" does not require the surface between the end points to be straight or planar.

An extension angle **199*a* is also illustrated as being the extension angle of the second leg side 409 extending from leg end face 196 to the second portion 409. The extension angle 199*a* will be the same measurement as the fourth extension angle 199**.

The third extension angle 198 and fourth extension angle 199 can be equal to each other or different from each other. The third extension angle 198 and the fourth extension angle 199 can be less than 10 degrees in some embodiments; less than 9 degrees in some embodiments; less than 8 degrees in some embodiments; less than 7 degrees in some embodiments; less than 6 degrees in some embodiments; less than 5 degrees in some embodiments. The third extension angle 198 and fourth extension angle 199 can be greater than 1 degree in some embodiments; greater than 2 degrees in some embodiments; greater than 3 degrees is some embodiments; and greater than 4 degrees in some embodiments. In one or more example embodiments, the third extension angle 198 and fourth extension angle 199 can be 2-7 degrees; and in one or more example embodiments, the third extension angle 198 and fourth extension angle 199 can be 3-5 degrees. In one or more example embodiments, the third extension angle 198 and fourth extension angle 199 can be about 4 degrees.

The leg end face 196 defines a recess 422. The recess 422 can be useful when arranging the blocks 170 together to form columns 252.

Preferably, the recess 422 is in complete extension between the first and second bearing faces 401, 402. The recess 422 extends inwardly toward the remaining portion of the block 170. Alternately phrased, the recess 422 extends inward toward the second side 176 of the body 172.

In preferred embodiments, the recess 422 extends at least partially between the first leg side 408 and second leg side 409. By "at least partially", it is meant that the recess 422 is not required to be in complete extension between the first leg side 408 and second leg side 409. For example, the recess 422 can start at the first leg side 408 and extend only part of the way to the second leg side 409 by stopping short of meeting the second leg side 409; or vice-versa, by starting at the second leg side 409 and extending only part of the way to the first leg side 408); or the recess 422 can extend at any location along the leg end face 196 and not extend fully to the first leg side 408 or second leg side 409. In one example, the recess 422 can extend by starting at one of the first leg side 408 or second leg side 409 and stop at the middle of the leg 192 at the leg center plane 416, with the remaining portion of the leg end face 196 to the other of the leg sides 408 or 409 being non-recessed.

In one or more example embodiments, the leg end face recess 422 extends inwardly at least 90% of an extension between the first leg side 408 and second leg side 409.

In some example embodiments, the leg end face recess 422 extends inwardly at least 95% of an extension between the first leg side 408 and second leg side 409.

In some example embodiments, the leg end face recess 422 extends inwardly at least 98% of an extension between the first leg side 408 and second leg side 409.

While many embodiments are possible, in FIG. 14, the leg end face recess 422 is defined by at least first leg end face section 196*a* and second leg end face section 196*b*. At least one of the first leg end face section 196*a* and second leg end face section 196*b* extend inwardly toward the second side 176 of the body 172. In the embodiment shown in FIG. 14, both the first leg end face section 196*a* and second leg end face section 196*b* extend inwardly toward the second side 176 of the body 172.

In one or more example embodiments, the first leg end face section 196*a* extends inwardly in at least partial extension from the first leg side 408.

In one or more example embodiments, the second leg end face section 196*b* extends inwardly in at least partial extension from the second leg side 409.

While many different shapes and geometries are possible, in preferred implementations, the first leg end face section 196*a* is a generally non-curved section. The second leg end face section 196*b* can preferably be a generally non-curved section.

In one or more example embodiments, the first leg end face section 196*a* can be a straight section. In one or more example embodiments, the second leg end face section 196*b* can be generally a straight section.

In some embodiments, the first leg end face section 196*a* and second leg end face section 196*b* meet at an intersection 424 in the leg end face 196. The intersection 424 of the first leg end face section 196*a* and second leg end face section 196*b* can be at any location between the first leg side 408 and second leg side 409. In one or more example embodiments, the intersection 424 is along a region of the leg end face 196 between 45-55% of the leg end face 196 between the first leg side 408 and second leg side 409. For example, the intersection 424 can be plus or minus 5% of the distance from the center plane 416, when the center plane 416 lies at 50% of the overall distance between the first leg side 408 and second leg side 409.

In some example embodiments, the intersection 424 of the first leg end face section 196*a* and second leg end face section 196*b* is along a region of the leg end face 196 between 48-52% of the leg end face 196 between the first leg side 408 and second leg side 409. For example, the intersection 424 can be plus or minus 2% of the distance from the center plane 416, when the center plane 416 lies at 50% of the overall distance between the first leg side 408 and second leg side 409.

In some example embodiments, the intersection 424 of the first leg end face section 196*a* and second leg end face section 196*b* is along a region of the leg end face 196 that is in the center between the first leg side 408 and second leg side 409, for example, even with the center plane 416, when the center plane 416 lies at 50% of the overall distance between the first leg side 408 and second leg side 409.

Referring to FIG. 14, the first leg end face section 196*a* extends inwardly in complete extension from the first leg side 408 to the second leg end face section 196*b*.

In many example embodiments, the second leg end face section 196*b* extends inwardly in complete extension from the second leg side 409 to the first leg end face section 196*a*.

Preferably, the first leg end face section 196*a* is angled inwardly at a fifth extension angle, described previously at reference numeral 200, relative to a plane orthogonal to the leg center plane 416. In the example shown, the plane orthogonal to the leg center plane 416 includes the end face center plane 411, meaning that in some preferred embodiments, the fifth extension angle 200 of the first leg end face section 196*a* is taken relative to the end face center plane 411. In example embodiments, the first leg end face section 196*a* extends to about the leg center plane 416 in extension from the first leg side 408. The term "extension angle" is as used above, and refers to measurement of a line drawn between endpoints. In this case, the endpoints are at the intersection of: (i) first leg side 408 and first leg end section 196*a;* and (ii) first leg end section 196*a* and leg center plane 416. "Extension angle" does not require the surface between the end points to be straight or planar.

The fifth extension angle 200, third extension angle 198, fourth extension angle 199 and second extension angle 182 can be equal to each other or different from each other. The fifth extension angle 200 can be less than 10 degrees in some embodiments; less than 9 degrees in some embodiments; less than 8 degrees in some embodiments; less than 7 degrees in some embodiments; less than 6 degrees in some embodiments; less than 5 degrees in some embodiments. The fifth extension angle 200 can be greater than 1 degree in some embodiments; greater than 2 degrees in some embodiments; greater than 3 degrees is some embodiments; and greater than 4 degrees in some embodiments. In one or more example embodiments, the fifth extension angle 200 can be 2-7 degrees; and in one or more example embodiments, the fifth extension angle 200 can be 3-5 degrees. In one or more example embodiments, the fifth extension angle 200 can be about 4 degrees.

The second leg end face section 196*b* is angled inwardly at a sixth extension angle, described previously at reference numeral 201, relative to the plane orthogonal to the leg center plane 416. In the example shown, the plane orthogonal to the leg center plane 416 includes the end face center plane 411, meaning that in some preferred embodiments, the sixth extension angle 201 of the second leg end face section 196*b* is taken relative to the end face center plane 411. In some example embodiments, the second leg end face section 196*b* extends to about the leg center plane 416 in extension from the second leg side 409. The term "extension angle" is as used above, and refers to measurement of a line drawn between endpoints. In this case, the endpoints are at the intersection of: (i) second leg side 409 and second leg end section 196*b;* and (ii) second leg end section 196*b* and leg center plane 416; although, again, as stated above, "extension angle" does not require the surface between the end points to be straight or planar.

The sixth extension angle 201, fifth extension angle 200, third extension angle 198, and fourth extension angle 199 can be equal to each other or different from each other. The sixth extension angle 201 can be less than 10 degrees in some embodiments; less than 9 degrees in some embodiments; less than 8 degrees in some embodiments; less than 7 degrees in some embodiments; less than 6 degrees in some embodiments; less than 5 degrees in some embodiments. The sixth extension angle 201 can be greater than 1 degree in some embodiments; greater than 2 degrees in some embodiments; greater than 3 degrees is some embodiments; and greater than 4 degrees in some embodiments. In one or more example embodiments, the sixth extension angle 201 can be 2-7 degrees; and in one or more example embodiments, the sixth extension angle 201 can be 3-5 degrees. In one or more example embodiments, the sixth extension angle 201 can be about 4 degrees.

By reviewing the column 252 in FIG. 17, it can be appreciated that for advantages in constructing the column 252 in a manner which will cause the blocks 170 to lock together and resist lateral movement between blocks 170, when the first bearing face 401 is used as the upper face, the second extension angle 182 (the angle of the second portion 210 extending from the second leg side 409 to the second end face 180); the third extension angle 198 (the angle the first leg side 408 extends away from the first portion 206); fourth extension angle 199 (the angle the second leg side 409 extends away from the second portion 210); and the fifth extension angle 200 (the angle the first leg end face section 196*a* is angled inwardly) are made to be within plus or minus five degrees of each other. In some embodiments, the second extension angle 182, third extension angle 198, fourth extension angle 199, and fifth extension angle 200 are within (plus or minus) three degrees of each other. In still further embodiments, the second extension angle 182, third extension angle 198, fourth extension angle 199, and fifth extension angle 200 are about equal, meaning that they are within (plus or minus) one degree of each other.

In preferred embodiments, the first extension angle 412, second extension angle 182, third extension angle 198, fourth extension angle 199, fifth extension angle 200 and sixth extension angle 201 are each less than 10 degrees.

Preferably, to achieve advantages in construction of structures, the first extension angle 412, second extension angle 182, third extension angle 198, fourth extension angle 199, fifth extension angle 200 and sixth extension angle 201 each is within plus or minus 5 degrees of the others. This arrangement results in the block 170 being capable of forming column 252 and free standing wall 262, in manner to lock the blocks 170 together and to be "tight" so that any free gaps in between adjacent blocks are small.

In one or more example embodiments, the first extension angle 412, second extension angle 182, third extension angle 198, fourth extension angle 199, fifth extension angle 200 and sixth extension angle 201 are within plus or minus 3 degrees of each other. Indeed, in some embodiments, each of the first extension angle 412, second extension angle 182, third extension angle 198, fourth extension angle 199, fifth extension angle 200 and sixth extension angle 201 are within plus or minus 1 degree of each other (i.e., about equal). When formed in this way, any gaps between adjacent blocks 170 are small.

By reviewing FIG. 14, certain observations about symmetry or asymmetry are gleaned for preferred embodiments of the block 170. For example, in preferred embodiments, the outer perimeter of the first bearing face 401 of the leg 192 is symmetrical about the leg center plane 416. The "outer perimeter of the first bearing face 401 of the leg 192" includes the first and second leg sides 408, 409 and leg end face 196. The leg center plane 416 is non-coplanar with the second side center plane 410. Preferably, the leg center plane 416 is spaced from and parallel to the second side center plane 410. The first bearing face 401 has an overall perimeter shape, as shown in FIG. 14 for example, and the non-leg portion of the outer perimeter shape of the first bearing face 401 is a non-mirror image relative to the second side center plane 410. By "outer perimeter shape of the first bearing face 401 of the non-leg portion", it is meant the second side 176; end faces 178, 180; first portion 206; and second portion 210. It does not include the first and second leg sides 408, 409 and leg end face 196. Of course, variations are possible.

In some example embodiments, the second end face 180 is angled at a seventh extension angle, previously described as angle 181, in a direction toward the first end face 178, as the second end face 180 extends from the second side 176 of the body 172 to the first side 174 of the body 172. The seventh extension angle 181 is non-zero and is not a right angle. The seventh extension angle 181 is measured relative to a plane parallel to the second side center plane 410. In preferred embodiments, the seventh extension angle 181 is acute, for example, less than 10 degrees. The seventh extension angle 181 can be greater than 1, for example, greater than 3 degrees. In some embodiments, the seventh extension angle 181 will be 7-9 degrees, for example about 8 degrees. The angled second end face 180 can allow for advantages in constructing structures from the block 170 including, for example, curved walls. The term "extension angle" is as defined above.

In the embodiment of FIG. 14, the distance between the first end face 178 and second end face 180 at the second side 176 of the body 172 (i.e., between the ends 406 and 407 of the second side 176) is greater than the distance between the first end face 178 and second end face 180 at the first side 174 of the body 172 (i.e., at the intersection of the first end face 178 and first portion 206; and at the intersection of the second end face 180 and the second portion 210).

As previously described, the block 170 can be used with other like blocks 170 to construct structures such as columns 252 (FIG. 16) and free standing walls 262.

For example, and in reference now to FIG. 18, the block 170 is configured and arranged such that when first block 270 and second block 271 (each constructed in accordance with block 170 as described above) are set next to each other, at least a portion of body second end face 180 of the first block 270 is in contact with at least a portion of the body first end face 178 of the second block 271. The second sides 176 of the first block 270 and second block 271 extend generally along a common line and point in the same direction. This results in receiving space (or gap) 276 between the legs 192 of the first block 270 and second block 271 forming an opening shaped to accept the leg 192 of third block 279 (the third block 279 being like-formed as block 170), when the third block 279 is oriented with its second side 176 pointed in an opposite direction of the second sides 176 of the first block 270 and second block 271.

The free standing wall 262 can be constructed by using a plurality of blocks 170 arranged in multiple courses. It should be understood that FIG. 18 shows a top view of the free standing wall 262, which can include multiple courses. Each course includes two rows 266, 268, of blocks 170, with the blocks 170 in each row 266, 268 laid end to end with the second side 176 of each block 170 forming a portion of an exposed face of the wall 262. By "end to end", it is meant that one of the second end faces 180 of a first block (such as block 270) will be adjacent and along side one of the first end faces 178 of a second block (such as block 271). The leg 192 of each block 170 (such as block 279) in a first of the rows 268 is between adjacent legs 192 of two blocks 170 (such as blocks 270, 271) in a second of the rows 266.

In a further example of structures that can be made from the block 170, reference is made to the column 252 of FIGS. 16 and 17. The block 170 is configured and arranged such that when first block 256, second block 257, third block 258, and fourth block 259, each made in accordance with block 170, are set next to each other: the first body end face 186 of the second block 257 is generally aligned with, and pointing in generally the same direction as, the second side 176 of the first block 256; the third block 258 is next to, and in contact with, the second block 257, with the first body end face 186 of the third block 258 generally aligned with, and pointing in generally the same direction as, the second side 176 of the second block 257; the fourth block 259 is between, and in contact with, the third block 258 and first block 256 with the first body end face 186 of the fourth block 259 generally aligned with, and pointing in generally the same direction as, the second side 176 of the third block 258; the first body end face 186 of the first block 256 is generally aligned with, and pointing in generally the same direction as, the second side 176 of the fourth block 259; and gaps are formed between: (i) respective second portions 210 of the first side 174 of each of the first 256, second 257, third 258, and fourth 259 blocks, and (ii) respective distal ends 419 of the leg 192 of each of the first 256, second 257, third 258, and fourth 259 blocks. In preferred arrangements, the gap is formed by the part of the distal ends 419 being the respective first leg end face section 196*a* of each of the blocks 256, 257, 258, and 259. Each of the gaps is filled by a leg 192 of one of the first 256, second 257, third 258, and fourth 259 blocks.

Of course, it should be noted that for the column 252 of FIG. 17, the first bearing face 401 is also the face 401 that is the upper face 188 in use. In many preferred embodiments, the column 252 includes multiple courses 254, and each course 254 will alternate between whether the first bearing face 401 or the second bearing face 402 is the upper face in use.

As can be seen in FIG. 16, the column 252 is depicted with multiple courses 254. Each course 254 includes four of the blocks 170 arranged in a rectangle, which can be a square, in the example shown. The second side 176 of each block 170 and the first end face 178 of an adjacent block forms a side of the column 252. In some preferred arrangements, the second side 176 of each block 170 and the first end face 178 of each block 170 are formed by splitting and, thus, has split faces 186, 184 respectively. The split faces 184, 186 will form the side of the column 252, in such arrangements.

In preferred arrangements, for advantageous constructions of the column 252, the leg end face 196 of each block 170 is angled to match an angle of one of the first or second leg sides 408, 409 (e.g., third extension angle 198, fourth extension angle 199) of an adjacent block 170. The leg end face 196 can include, for example, fifth extension angle 200, which can be within (plus or minus) 1 degree of fourth extension angle 199. This construction will result in the blocks 170 being locked together to resist lateral movement of each of the blocks 170 in the course 254.

As can be seen in FIG. 16, the blocks 170 in one course 254 (for example, a second course 432) are rotated 90 degrees around a vertical axis of the column 254 compared to the blocks 170 in an adjacent course 254 (for example, a first course 430). In this example, the first course 430 is constructed with the first bearing face 401 as the upper face, and the next adjacent course, second course 432, is arranged on top of the first course 430 using the second bearing face 402 as the upper face. This construction of the column 252 results in a running bond for the column 252.

The above represents examples and principles. Many embodiments can be made utilizing these principles.

What is claimed is:

1. A building block comprising:

(a) a body having opposite first and second sides, opposite first and second end faces extending between the first and second sides, and opposite upper and lower faces extending between the first and second sides and the first and second end faces;

(i) the upper and lower faces being planar and parallel to each other;

(b) a leg extending from the first side of the body;

(i) the leg having opposite leg sides and a leg end face;

(ii) the leg sides extending between the first side of the body and the leg end face;

(iii) the first side of the body having a first portion extending between the first end face and one of the leg sides;

(iv) the first side of the body having a second portion extending between the second end face and the other of the leg sides;

(v) a widest portion of the leg being at the leg end face; and (vi) the leg end face having a first section recessed inwardly from one of the leg sides at an angle and a second section recessed inwardly from the other of the leg sides at an angle which is the same as the angle of the first section.

2. The block of claim 1 wherein:

(a) the first portion of the first side angles inwardly as it extends from the first end face to one of the leg sides; and (b) the second portion of the first side angles inwardly as it extends from the second end face to the other of the leg sides.

3. The block of claim 2 wherein:

(a) the angle of the first portion to the one of the leg sides, and the angle of the second portion to the other of the leg sides is the same angle as the angle of the first section leg end face and second section leg end face.

4. The block of claims 1 wherein:

(a) the block is made of dry cast concrete and the second side of the body is a split face.

5. The block of claim 4 wherein:

(a) the first end face is a split face.

6. The block of claim 1 wherein:

(a) the body is longer at the second side than the first side.

7. The block of claim 1 wherein:

(a) the second end face extends inwardly as it extends from the second side of the body to the first side of the body.

* * * * *